US008475988B2

(12) United States Patent
Sugiura et al.

(10) Patent No.: US 8,475,988 B2
(45) Date of Patent: Jul. 2, 2013

(54) RESIN-FILLED FERRITE CARRIER CORE MATERIAL FOR ELECTROPHOTOGRAPHIC DEVELOPER, FERRITE CARRIER AND ELECTROPHOTOGRAPHIC DEVELOPER USING THE FERRITE CARRIER

(75) Inventors: Takao Sugiura, Kashiwa (JP); Takashi Hikichi, Nagareyama (JP); Hiromichi Kobayashi, Nagareyama (JP)

(73) Assignee: Powdertech Co., Ltd., Chiba (JP)

( * ) Notice: Subject to any disclaimer, the term of this patent is extended or adjusted under 35 U.S.C. 154(b) by 14 days.

(21) Appl. No.: 13/019,485

(22) Filed: Feb. 2, 2011

(65) Prior Publication Data

US 2011/0195357 A1 Aug. 11, 2011

(30) Foreign Application Priority Data

Feb. 5, 2010 (JP) ..... 2010-024810

(51) Int. Cl.
*G03G 9/107* (2006.01)

(52) U.S. Cl.
USPC ..... 430/111.32; 430/111.1; 430/111.41; 430/111.3; 430/111.31

(58) Field of Classification Search
USPC ..... 430/111.1–111.4
See application file for complete search history.

(56) References Cited

U.S. PATENT DOCUMENTS

| | | | | |
|---|---|---|---|---|
| 5,427,884 | A * | 6/1995 | Ohtani et al. | 430/108.14 |
| 2006/0269862 | A1* | 11/2006 | Kobayashi et al. | 430/111.31 |
| 2008/0241729 | A1* | 10/2008 | Kayamoto et al. | 430/111.32 |
| 2009/0246675 | A1* | 10/2009 | Nakamura et al. | 430/111.31 |

FOREIGN PATENT DOCUMENTS

| | | |
|---|---|---|
| JP | 2006-317620 | 11/2006 |
| JP | 2006-337579 | 12/2006 |
| JP | 2007-57943 | 3/2007 |
| JP | 2007-218955 | 8/2007 |
| JP | 2008-96977 | 4/2008 |
| JP | 2008-107841 | 5/2008 |
| JP | 2008-175883 | 7/2008 |

OTHER PUBLICATIONS

English Language Abstract of 2007-218955.
English Language Abstract of 2006-317620.
English Language Abstract of 2008-107841.
English Language Abstract of 2008-96977.
English Language Abstract of 2006-337579.
English Language Abstract of 2007-57943.
English Language Abstract of 2008-175883.

* cited by examiner

*Primary Examiner* — Mark F Huff
*Assistant Examiner* — Rashid Alam
(74) *Attorney, Agent, or Firm* — Greenblum & Bernstein, P.L.C.

(57) ABSTRACT

Disclosed are a resin-filled ferrite carrier core material for an electrophotographic developer, including a porous ferrite particle, wherein the composition of the porous ferrite particle is represented by the following formula (1), and part of (MgO) and/or ($Fe_2O_3$) in the following formula (1) is replaced with SrO; a ferrite carrier obtained by filling a resin in the voids of the ferrite carrier core material; and an electrophotographic developer using the ferrite carrier:

$$(MgO)x(Fe_2O_3)y \quad (1)$$

$$\left(\begin{array}{l} x = 10 \text{ mol \% or more and less than 25 mol \%} \\ y = \text{exceeding 75 mol \% and 90 mol \% or less} \\ x + y = 100 \text{ mol \%} \end{array}\right).$$

12 Claims, 2 Drawing Sheets

RESIN-FILLED FERRITE CARRIER CORE MATERIAL FOR ELECTROPHOTOGRAPHIC DEVELOPER, FERRITE CARRIER AND ELECTROPHOTOGRAPHIC DEVELOPER USING THE FERRITE CARRIER

BACKGROUND OF THE INVENTION

1. Field of the Invention

The present invention relates to a resin-filled ferrite carrier core material and a ferrite carrier, used in a two-component electrophotographic developer used in apparatuses such as copiers and printers, specifically relates to a resin-filled ferrite carrier core material for an electrophotographic developer, a ferrite carrier and an electrophotographic developer using the ferrite carrier, wherein the electrophotographic developer is capable of maintaining a high charging ability for a long period of time while the advantages of a resin-filled carrier are being maintained, is capable of attaining a high image quality and is capable of reducing image defects.

2. Description of the Related Art

An electrophotographic development method is a method in which development is performed by adhering the toner particles in a developer to the electrostatic latent image formed on a photoreceptor, and the developer used in such a method is classified into a two-component developer composed of toner particles and carrier particles and a one-component developer using only toner particles.

As a development method using, among such developers, a two-component developer composed of toner particles and carrier particles, previously a method such as a cascade method has been adopted, but currently a magnetic brush method using a magnet roll predominates.

In a two-component developer, the carrier particles serve as a carrying substance to form a toner image on the photoreceptor in such a way that the carrier particles are stirred together with the toner particles in a developer box filled with the developer to impart an intended charge to the toner particles, and further, convey the thus charged toner particles to the surface of the photoreceptor to form the toner image on the photoreceptor. The carrier particles remaining on a development roll which holds a magnet again return from the development roll into the developer box to be mixed and stirred with the fresh toner particles and to be repeatedly used for a predetermined period of time.

In contrast to a one-component developer, a two-component developer is such that the carrier particles are mixed and stirred with the toner particles, thus charge the toner particles, and further have a function to convey the toner particles, and a two-component developer is excellent in the controllability in designing developers. Accordingly, two-component developers are suitable for full-color development apparatuses required to offer high image quality and for high speed printing apparatuses required to be satisfactory in the reliability and durability in image maintenance.

In two-component developers used in the above-described manner, the image properties such as the image density, fogging, white spots, gradation and resolution are each required to exhibit a predetermined value from the initial stage, and further these properties are required to be invariant and to be stably maintained during the endurance printing. For the purpose of stably maintaining these properties, the properties of the carrier particles contained in the two-component developers are required to be stable.

As the carrier particles which form two-component developers, there have hitherto been used iron powder carriers such as an iron powder carrier in which the surface of an iron powder is coated with an oxide film or an iron powder carrier in which the surface of an iron powder is coated with a resin. Such iron powder carriers are high in magnetization and also high in conductivity, and hence have an advantage that images satisfactory in the reproducibility of the solid print portions thereof are easily obtained.

However, the true specific gravities of such iron powder carriers are as heavy as about 7.8, and the magnetizations of such iron power carriers are too high. Accordingly, the stirring and mixing of such an iron powder carrier with the toner particles in the developer box tend to cause the fusion bonding of the toner-constituting components to the surface of the iron powder carrier, namely, the so-called toner spent. The occurrence of such a toner spent reduces the effective surface area of the carrier, and the triboelectric charging ability of the carrier in relation to the toner particles tends to be degraded.

Additionally, in the resin-coated iron powder carrier, the resin on the surface is exfoliated by the stress at the time of endurance operation to expose the core material (iron powder) which is highly conductive and low in dielectric breakdown voltage, and accordingly the charge leakage occurs as the case may be. Such charge leakage breaks the electrostatic latent image formed on the photoreceptor, causes brush strokes or the like to occur on the solid print portion, and makes it difficult to obtain a uniform image. Due to these reasons, currently the iron powder carriers such as oxide-coated iron powder carriers and resin-coated iron powder carriers have become decreasingly used.

In recent years, in place of the iron powder carriers, ferrites each having a true specific gravity of as light as about 5.0 and being low in magnetization have been used as carriers, and resin-coated ferrite carriers in each of which the surface of the ferrite is further coated with a resin have been frequently used, and accordingly the operating lives of the developers have been dramatically extended.

Recently office networking has been promoted, and the age of monofunctional copiers develops into the age of multifunctional copiers; the service system has also shifted from the age of the system such that a contracted service man conducts periodic maintenance inclusive of the replacement of the developer to the age of the maintenance-free system; thus, the market has further enhanced demand for further longer operating life of the developer.

Under such circumstances, for the purpose of reducing the carrier particle weight and extending the developer operating life, there have been proposed a variety of magnetic powder-dispersed carriers in each of which magnetic fine particles are dispersed in a resin.

Although such magnetic powder-dispersed carriers are light in true specific gravity and advantageous for the purpose of extending the carrier operating life, such magnetic powder-dispersed carriers tend to be high in resistance, make it difficult to easily attain intended image densities and disturb the charge amount control. Additionally, the magnetization control is performed on the basis of the amount of the dispersed magnetic powder, and hence it is difficult to establish a compatibility between the true specific gravity (an index for the operating life) and another physical property (image property control). Yet additionally, the magnetic powder-dispersed carriers are prepared by agglomerating magnetic powders with resins, and hence are low in hardness and tend to crack and tend to undergo magnetic powder detachment, thermal fusion and thermal deformation.

As a substitute for the magnetic powder-dispersed carrier, there have been proposed a resin-filled carrier in which the voids in a porous carrier core material are filled with a resin. The resin-filled carrier is prepared by forming extremely porous core material particles under suppression of crystal growth due to the control of the composition and the sintering (firing) conditions and by filling the resulting porous core material particles with an optional resin, and hence the filling of the porous core material particles with a resin enables to reduce the true specific gravity and to attain a long operating life. Additionally, by selecting the resin to be filled, the charge amount and the like can be easily controlled. As compared to the magnetic powder-dispersed carriers, the resin-filled carriers have advantages such that the resin-filled carriers are higher in strength and are free from the occurrence of the cracking, deformation and melting due to heat or impact.

However, a Mn-containing ferrite is low in electric resistance, and hence the dielectric breakdown voltage of the Mn-containing ferrite cannot be sufficiently increased even when the Mn-containing ferrite is filled with a resin, and thus offers a cause for image defects such as white spots. Additionally, when a ferrite is made to have such porousness that allows the filling of an intended amount of a resin, it is necessary to produce the porousness (pores) under the conditions that the sintering is not yet made to completely proceed by setting the sintering temperature of the ferrite at a low temperature. When the sintering is performed at such a low temperature, the inclusion of Mn in the ferrite tends to cause the generation of particles having low magnetization and tends to offer a problem such that the porousness (pore conditions) is different among the particles.

Further, it is desired not to use heavy metals such as Cu, Zn, Ni and Mn from the viewpoints such as the recent environmental load reduction and the occupational safety and health.

Accordingly, there has been proposed a carrier using a Mg-containing carrier core material. Specifically, Japanese Patent Laid-Open No. 2007-218955 discloses a carrier particle obtained by coating with a resin a carrier core material being mainly composed of Mg and/or Mn, having a magnetic phase in which the amount of MgO and/or MnO is 0 to 50 (molar ratio) and a nonmagnetic phase including one or more of $SiO_2$, $Al_2O_3$ and $Al(OH)_2$, and having a pore volume of 0.03 to 0.15 ml/g; an example discloses a carrier using a carrier core material obtained by mixing $Fe_2O_3$ and $Mg(OH)_2$ in a ratio of $Fe_2O_3$:$Mg(OH)_2$=80:20.

The content range of MgO and/or MnO disclosed in the above-described Japanese Patent Laid-Open No. 2007-218955 is extremely wide; it is impossible to satisfy both of the intended pore volume and the intended magnetic property over the whole of this range. In particular, in the case where Mn is not contained and in the case where the amount of Mg is small, when the sintering is performed at a sintering temperature set at a low temperature for the purpose of increasing the pore volume, a high pore volume is obtained, but at the same time, the magnetization is degraded. Additionally, in the sintering temperature range where the intended pore volume is obtained, the variation of the magnetization in relation to the sintering temperature is large to remarkably degrade the production stability and the development reproducibility of magnetization.

Japanese Patent Laid-Open No. 2006-317620 discloses a carrier powder for an electrophotographic developer wherein the carrier powder has as the core material thereof a ferrite particle that uses as a MgO source a $Mg(OH)_2$-containing substance and contains MgO in a content of 5 to 35 mol %. When a ferrite is produced in such a composition range, it is possible to form dimples, for obtaining resin exfoliation strength, on the surface of the ferrite particles as described in Japanese Patent Laid-Open No. 2006-317620, but it is impossible to obtain a resin-filled carrier in which pores are proactively formed in the core material, a resin is filled (impregnated) in the pores and thus the weight reduction is achieved. In particular, in the case where X is less than 25 mol % in the formula $(MgO)_x(Fe_2O_3)_{100-x}$, when the sintering is performed at a sintering temperature set at a low temperature for the purpose of increasing the pore volume, a high pore volume is obtained, but at the same time, the magnetization is degraded. Additionally, in the sintering temperature range where the intended pore volume is obtained, the variation of the magnetization in relation to the sintering temperature is large to remarkably degrade the production stability and the development reproducibility of magnetization.

Japanese Patent Laid-Open No. 2008-107841 discloses a carrier for an electrophotographic developer wherein a core material has, as the constituent components thereof, iron, oxygen and magnesium and contains magnesium in a content of 0.5 to 10% by weight, and the core material is coated with a resin. When the above-described magnesium-containing ferrite is described with the general formula of the ferrite, it is meant that X is 2.3 to 33.8 mol % in $(MgO)_x(Fe_2O_3)_{100-x}$ Japanese Patent Laid-Open No. 2008-107841 does not take as its object the increase of the void volume of the particles, as described in the paragraph [0010], and relates to a resin-coated carrier in which a ferrite core obtained by sintering at a somewhat high sintering temperature is coated with a resin, and the resin-coated carrier is completely different from a resin-filled carrier obtained by filling a resin in the pores obtained in the particles that are made proactively porous. Therefore, it is impossible to stably obtain the intended pore volume and the intended magnetic properties in the whole range of the Mg content extending over such a wide range as described in Japanese Patent Laid-Open No. 2008-107841.

Japanese Patent Laid-Open No. 2008-96977 discloses a carrier prepared by coating with a resin the surface of core particles composed of a ferrite containing at least magnesium element, wherein the maximum grain size on the surface of the core particles is 2 to 5 μm. Additionally, Japanese Patent Laid-Open No. 2008-96977 describes that the ferrite core particles containing manganese element are preferable, and in the paragraph [0058] thereof, there is a description that the proportion of $Mg(OH)_2$ is preferably 10 to 40 mol %. There is also a description that in such a core material, the grain size is comparatively small, and by making the grain size fall within a specific grain size range, the surface of the core particles is made to have uniform roughness to consequently facilitate uniform coating of the core particles with a resin. It is also disclosed that it is difficult to make the grain size less than 2 μm in the production of the core particles. The ferrite described in Japanese Patent Laid-Open No. 2008-96977 is substantially a Mn-containing ferrite, and suffers from problems such that the electric resistance of the core material tends to be low and the variations of the magnetization and the porousness (pore formation condition) among particles tend to occur. The use of a heavy metal is also ineffective from the viewpoints such as the recent environmental regulation and the recent reduction of environmental load. Further, the proportion of $Mg(OH)_2$ falling over a range as wide as 10 to 40 mol % makes it difficult to stably obtain the intended pore volume and the intended magnetic properties.

On the other hand, Japanese Patent Laid-Open Nos. 2006-337579 and 2007-57943 each disclose a resin-filled carrier in which a resin is filled in the voids (pores) formed in a core material, and also describe that various elements can be used as core materials. The resin-filled carriers in these Japanese Patent Laid-Open Nos. 2006-337579 and 2007-57943 undoubtedly each have an advantage that high-quality images tend to be obtained over a long period of time due to the effects such as the achieved weight reduction, but are each substantially a Mn-containing ferrite, and each suffer from problems such that the electric resistance of the carrier core material tends to be low and the variations of the magnetization and the porousness (pore formation condition) among particles tend to occur. Further, the use of a heavy metal is ineffective from the viewpoints such as the recent environmental regulation and the recent reduction of environmental load.

Japanese Patent Laid-Open No. 2008-175883 discloses a carrier for an electrophotographic developer, using a carrier core material in which the Mn content is reduced as much as possible. However, the carrier described in Japanese Patent Laid-Open No. 2008-175883 is mainly composed of Li, and suffers from a problem such that the presence of Li increases the hygroscopicity, and the charging property and the electric resistance property are largely varied depending on the use environment (temperature and humidity). In particular, when such a carrier is used as a resin-filled carrier, the specific surface area is increased due to the porousness of the carrier core material, and hence is far from satisfying the recent high demands for the reduction of the temperature and humidity dependence.

As described above, there has hitherto been demanded a resin-filled ferrite carrier for an electrophotographic developer, capable of maintaining high charging ability for a long period of time, capable of obtaining a high image quality and capable of reducing the image defects, while the advantages of the above-described resin-filled carrier are being maintained.

SUMMARY OF THE INVENTION

Accordingly, an object of the present invention is to provide: a resin-filled ferrite carrier core material for an electrophotographic developer, capable of maintaining high charging ability for a long period of time, capable of obtaining high image quality and capable of reducing the image defects, while the advantages of the resin-filled carrier are being maintained; a ferrite carrier; and an electrophotographic developer using the ferrite carrier.

The present inventors reached the present invention by discovering, as the results of a diligent investigation performed for the purpose of solving the above-described problems, that the above-described problems can be solved by using as a carrier core material a porous ferrite particle which substantially does not contain Mn, is mainly composed of Mg, Fe and O, and is partially replaced with Sr.

Specifically, the present invention provides a resin-filled ferrite carrier core material for an electrophotographic developer, including a porous ferrite particle, wherein the composition of the porous ferrite particle is represented by the following formula (1), and part of (MgO) and/or ($Fe_2O_3$) in the following formula (1) is replaced with SrO:

$$(MgO)x(Fe_2O_3)y \quad (1)$$

$$\left(\begin{array}{l} x = 10 \text{ mol \% or more and less than 25 mol \%} \\ y = \text{exceeding 75 mol \% and 90 mol \% or less} \\ x + y = 100 \text{ mol \%} \end{array}\right)$$

In the resin-filled ferrite carrier core material for an electrophotographic developer according to the present invention, preferably the replacement amount of SrO is 0.1 to 2.5 mol % of the porous ferrite particle.

In the resin-filled ferrite carrier core material for an electrophotographic developer according to the present invention, preferably the pore volume of the porous ferrite particle is 40 to 160 $mm^3/g$, the peak pore size of the porous ferrite particle is 0.3 to 2.0 μm, and the pore size variation, dv, in the pore size distribution, represented by the following formula (2) is 1.5 or less:

$$dv = |d_{84} - d_{16}|/2 \quad (2)$$

$d_{15}$: Pore size calculated from the pressure applied to mercury when the amount of the intruded mercury reaches 16% in relation to the total amount of the intruded mercury in the high pressure region, defined as 100%

$d_{84}$: Pore size calculated from the pressure applied to mercury when the amount of the intruded mercury reaches 84% in relation to the total amount of the intruded mercury in the high pressure region, defined as 100%

In the resin-filled ferrite carrier core material for an electrophotographic developer according to the present invention, preferably the saturation magnetization of the porous ferrite particle is 55 to 80 $Am^2/kg$.

In the resin-filled ferrite carrier core material for an electrophotographic developer according to the present invention, preferably the porous ferrite particle is obtained by sintering in a reductive atmosphere and subsequent further sintering in a reductive atmosphere or in an inert atmosphere.

In the resin-filled ferrite carrier core material for an electrophotographic developer according to the present invention, preferably the saturation magnetization of the porous ferrite particle before the step of final sintering is 55 to 80 $Am^2/kg$, and the ratio between the saturation magnetization before the step of final sintering and the saturation magnetization after the step of final sintering (the saturation magnetization before the step of final sintering/the saturation magnetization after the step of final sintering) is 0.75 to 1.25.

In the resin-filled ferrite carrier core material for an electrophotographic developer according to the present invention, preferably the pore volume of the porous ferrite particle before the step of final sintering is 150 $mm^3/g$ or more, and the ratio between the pore volume before the step of final sintering and the pore volume after the step of final sintering (the pore volume before the step of final sintering/the pore volume after the step of final sintering) is 1.2 to 6.0.

Additionally, the present invention provides a resin-filled ferrite carrier for an electrophotographic developer, obtained by filling a resin in the pores of the ferrite carrier core material including the ferrite particle.

In the resin-filled ferrite carrier for an electrophotographic developer according to the present invention, preferably the resin is a silicone resin.

In the resin-filled ferrite carrier for an electrophotographic developer according to the present invention, preferably the amount of the resin filled in the porous ferrite particle is 6 to 20 parts by weight in relation to 100 parts by weight of the porous ferrite particle.

In the resin-filled ferrite carrier for an electrophotographic developer according to the present invention, preferably the surface of the resin-filled ferrite carrier for an electrophotographic developer is coated with a resin.

In the resin-filled ferrite carrier for an electrophotographic developer according to the present invention, preferably the volume average particle size thereof is 20 to 70 μm, the saturation magnetization thereof is 53 to 78 $Am^2/kg$, the particle density thereof is 3.5 to 4.3 $g/cm^3$, the apparent density thereof is 1.0 to 2.2 $g/cm^3$ and the content of the particles of less than 24 μm is 5% by volume or less.

Additionally, the present invention provides an electrophotographic developer including the resin-filled ferrite carrier and a toner.

The electrophotographic developer according to the present invention is also used as a refill developer.

The resin-filled ferrite carrier core material for an electrophotographic developer according to the present invention and the ferrite carrier obtained by filling a resin in the voids of the concerned ferrite carrier core material are low in specific gravity and are allowed to achieve weight reduction, hence are excellent in durability and are allowed to attain long operating lives, and moreover, are higher in strength as compared to the magnetic powder-dispersed carrier and are free from the occurrence of the cracking, deformation and melting due to heat or impact. Additionally, the concerned resin-filled ferrite carrier core material and the concerned ferrite carrier are high in charging ability, are capable of maintaining the charging ability even with stirring for a long period of time, and moreover, offer soft magnetic brushes so as to attain high image quality. Additionally, the concerned resin-filled ferrite carrier core material and the concerned ferrite carrier do not contain Mn, and hence the electric resistance of the carrier core material is not too low, high image quality is obtained, image defects such as white spots can be reduced, the variations of the magnetization and the porousness (pore formation condition) among particles are small, and the image defects such as carrier beads carry over can be reduced. Yet additionally, the concerned resin-filled ferrite carrier core material and the concerned ferrite carrier do not contain heavy metals such as Cu, Zn, Ni and Mn, and hence are adaptable to the current environmental regulation.

DETAILED DESCRIPTION OF THE EMBODIMENTS

Figure 1:
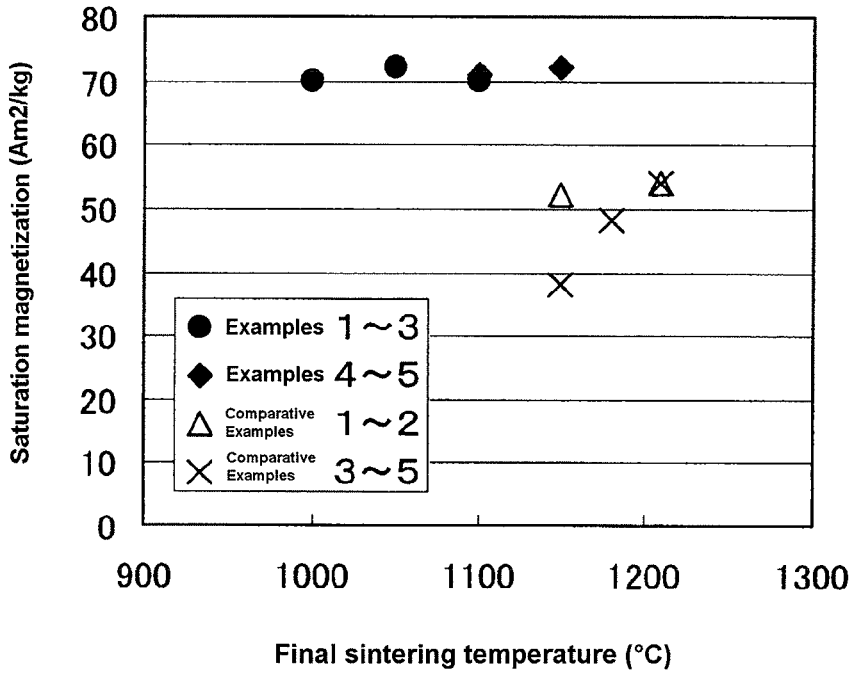
FIG. 1 is a graph showing the relation between the final sintering temperature and the saturation magnetization in the porous ferrite particles of Examples 1 to 5 and Comparative Example 1 to 5.

Hereinafter, the mode for carrying out the present invention is described.

<Resin-Filled Ferrite Carrier Core Material for an Electrophotographic Developer and the Ferrite Carrier According to the Present Invention>

The resin-filled ferrite carrier core material for an electrophotographic developer according to the present invention includes a porous ferrite particle and is mainly composed of Mg, Fe and O. The inclusion of Mg, Fe and O as the main components enables the concerned resin-filled ferrite carrier core material to be high in charging ability and to maintain the charging ability even when stirring is performed over a long period of time. Additionally, heavy metals and Mn are not substantially used, and hence the electric resistance of the carrier core material is not too low and the concerned resin-filled ferrite carrier core material can be adaptable to the current environmental regulation.

A Mg-containing ferrite tends to maintain the porousness even when the sintering temperature is increased, and hence is suitable for the carrier core material of a resin-filled carrier. Additionally, a ferrite including Mg and Fe as the main components allows the saturation magnetization thereof to remain unvaried and allows only the pore volume to vary over a specific sintering temperature width, and consequently, a resin-filled carrier having an intended specific gravity is obtained, with a small production variation.

The composition of the porous ferrite particle is represented by the following formula (1), and part of the (MgO) and/or the ($Fe_2O_3$) in the following formula (1) is replaced with SrO:

$$(MgO)x(Fe_2O_3)y \quad (1)$$

$$\left(\begin{array}{l} x = 10 \text{ mol \% or more and less than 25 mol \%} \\ y = \text{exceeding 75 mol \% and 90 mol \% or less} \\ x + y = 100 \text{ mol \%} \end{array}\right)$$

In the above-described formula (1), x is 10 mol % or more and less than 25 mol %, preferably 12 to 23 mol % and particularly preferably 13 to 22 mol %. Additionally, y exceeds 75 mol % and is 90 mol % or less, is preferably 77 to 88 mol % and most preferably 78 to 87 mol %. In the above-described composition, when the porous ferrite particle is sintered in a range from 1050 to 1200° C., the porous ferrite particle develops an approximately constant saturation magnetization independent of the temperature, and hence the production variation is small. Additionally, the pore volume is easily variable by the sintering temperature, and hence an intended pore volume can be easily obtained, and consequently, a resin-filled carrier having an intended specific gravity is obtained. When the above-described x is less than 10 mol % and the above-described y exceeds 90 mol % in the composition of the porous ferrite particle, although it is possible to increase the pore volume by sintering at a low temperature, it is difficult to increase the magnetization; although it is possible to increase the magnetization by sintering at a high temperature, the pore volume is made small. When the above-described x is 25 mol % or more and the above-described y is 75 mol % or less, it is possible to obtain an intended pore volume in the above-described sintering temperature region, but the magnetization is low.

Part of (MgO) and/or ($Fe_2O_3$) in the above-described formula (1) is replaced with SrO. The inclusion of SrO in the porous ferrite particles enables to reduce the magnetization variation among the particles. Additionally, when the sintering is performed at a sintering temperature set at a low temperature for the purpose of attaining porousness, there occurs an effect of suppressing the magnetization degradation. Further, the inclusion of SrO in an appropriate amount enables to obtain an intended pore volume even with sintering at a low temperature, without degrading the magnetization. The replacement amount of SrO is preferably 0.1 to 2.5 mol % of the porous ferrite particle and most preferably 0.1 to 1.5 mol % of the porous ferrite particle. When the replacement amount of SrO is less than 0.1 mol %, the above-described replacement effect of SrO is not obtained, and when the replacement amount of SrO exceeds 2.5 mol %, the remnant magnetization and the coercive force are large, and hence the carrier undergoes aggregation due to magnetic force even after being separated away from a magnetic brush, and unpreferably the mixing performance of the carrier with the toner is remarkably degraded.

The porous ferrite particle used in the present invention does not include Cu, Zn, Ni and Mn at a level equal to or higher than the level of the inevitable impurity level or the concomitant impurity level. No inclusion of Mn makes the electric resistance of the carrier core material not too low. Consequently, the image defects such as white spots can be reduced. Additionally, the variations of the magnetization and the porousness (pore formation condition) among particles are small, and the image defects such as carrier beads carry over can be reduced. Further, no inclusion of heavy metals such as Cu, Zn, Ni and Mn makes the carrier adaptable to the current environmental regulation. With respect to the contents of these heavy metals, the total amount of the above-described elements is preferably suppressed to be 2.0% by weight or less, more preferably to be 1.5% by weight or less and most preferably to be 1.0% by weight or less.

The electric resistances of the porous ferrite particle at 50 V and 100 V are both preferably $10^5\Omega$ or more, more preferably $10^6\Omega$ or more and most preferably $10^6$ to $10^9\Omega$.

[Electric Resistance of Porous Ferrite Particle]

The measurement of the electric resistance of the porous ferrite particle is performed as follows.

Nonmagnetic parallel flat plate electrodes (10 mm×40 mm) were made to face each other with an electrode separation of 6.5 mm, and 200 mg of a weighed sample was packed between the electrodes. By attaching a magnet (the surface magnetic flux density: 1500 Gauss, the magnet area in contact with the electrode: 10 mm×30 mm) to the parallel flat plate electrodes, the sample is held between the electrodes. By sequentially applying voltages of 50 V and 100 V, the electric resistance for each of these applied voltages is measured with an insulation resistance meter (SM-8210, manufactured by DKK-TOA Corporation). The measurement is performed in a constant-temperature, constant-humidity room controlled at a room temperature of 25° C. and a humidity of 55%.

The pore volume of the porous ferrite particle is preferably 40 to 160 $mm^3/g$, more preferably 40 to 100 $mm^3/g$ and most preferably 50 to 80 $mm^3/g$. When the pore volume of the porous ferrite particle is less than 40 $mm^3/g$, no sufficient amount of a resin can be filled in and hence no weight reduction can be achieved. When the pore volume of the porous ferrite particle exceeds 160 $mm^3/g$, even the filling of the resin cannot maintain the strength of the carrier.

The peak pore size of the porous ferrite particle is preferably 0.3 to 2.0 μm, more preferably 0.3 to 1.8 μm and most preferably 0.3 to 1.5 μm. When the peak pore size of the porous ferrite particle is 0.3 μm or more, the asperity size of the surface of the core material is of an appropriate size, hence the contact area with the toner is increased, the triboelectric charging with the toner is performed efficiently, and consequently the charge rise property is improved in spite of the low specific gravity. When the peak pore size of the porous ferrite particle is less than 0.3 μm, such an advantageous effect is not obtained and the carrier surface after filling becomes flat and smooth, and hence, no sufficient stress with the toner is given to the carrier that is low in specific gravity to degrade the charge rise. When the peak pore size of the porous ferrite particle exceeds 2.0 μm, the resin-dwelling area of the particles becomes large in relation to the surface area of the particles, and accordingly the aggregation between the particles tends to occur at the time of the resin filling and large proportions of aggregated particles and irregularly shaped particles are found in the carrier particles having been filled with the resin. Consequently, the stress in endurance printing disintegrates the aggregated particles to offer a cause for the charge variation. Such a carrier core material using the porous ferrite particles that have a peak pore size exceeding 2.0 μm means that the asperities of the carrier core material surface are large; this means that the particles themselves are poor in shape and also poor in strength, and consequently the stress due to endurance printing causes the cracking of the carrier particles themselves to offer a cause for the charge variation.

As described above, the pore volume and the peak pore size designed to fall within the above-described ranges enable to obtain a resin-filled carrier that is free from the above-described problems and is appropriately reduced in weight.

[Pore Size and Pore Volume of Porous Ferrite Particle]

The measurements of the pore size and the pore volume of the porous ferrite particle are performed as follows. Specifically, the measurement is performed with the mercury porosimeters, Pascal 140 and Pascal 240 (manufactured by Thermo Fisher Scientific Inc.). A dilatometer CD3P (for powder) is used, and a sample is put in a commercially available gelatin capsule with a plurality of bored holes and the capsule is placed in the dilatometer. After deaeration with Pascal 140, mercury is charged and a measurement in the low pressure region (0 to 400 kPa) is performed as a first run. Successively, the deaeration and another measurement in the low pressure region (0 to 400 kPa) are performed as a second run. After the second run, the total weight of the dilatometer, the mercury, the capsule and the sample is measured. Next, a high pressure region (0.1 MPa to 200 MPa) measurement is performed with Pascal 240. After this measurement, from the data (pressure, amount of the intruded mercury) for the pore sizes of 3 μm or less derived from the pressure, the pore volume, the pore size distribution and the peak pore size of the porous ferrite particle are obtained. When the pore size is obtained, the control-analysis dual-purpose software appended to the apparatus, PASCAL 140/240/440 is used, and the calculation is performed under the conditions that the surface tension and the contact angle of mercury are 480 dyn/cm and 141.3°, respectively. The peak pore size is obtained by calculating dV/d log d on the same software and by adopting the most freq. value. In the calculation of dV/d log d, the Number of point to average is set at 6 and the Smooth Dumping factor is set at 0.95.

In the pore size distribution of the porous ferrite particle, the variation dv of the pore size is preferably 1.5 or less, more preferably 0.9 or less and most preferably less than 0.8. Here, the total amount of the intruded mercury in the high pressure region is defined as 100%, the pore size calculated from the pressure applied to the mercury when the intrusion amount reaches 84% is denoted by $d_{84}$, and the pore size calculated from the pressure applied to the mercury when the intrusion amount reaches 16% is denoted by $d_{16}$. The dv value is calculated from the following formula (2).

$$dv=|d_{84}-d_{16}|/2 \quad (2)$$

When the variation of the pore size of the porous ferrite particle, dv, exceeds 1.5 means that the variations of the asperities and the core material shape among particles come to be large. Therefore, when the dv value exceeds the intended range, the among-particle variations of the particle shape and the aggregation due to the filing tend to occur, and consequently offer the causes for the charge rise degradation and the large charge variation.

The saturation magnetization of the porous ferrite particle according to the present invention is preferably 55 to 80 $Am^2/kg$, more preferably 60 to 75 $Am^2/kg$ and most preferably 63 to 73 $Am^2/kg$.

In copiers and printers generally used in offices, when carriers are used for apparatuses having relatively slow development speed, even carriers having a saturation magnetization of 40 to 50 $Am^2/kg$ can be used as the case may be. The use of carriers having relatively low magnetization softens the magnetic brush ears and thus high image quality is achieved as the case may be. However, when high developing ability is required as in high speed machines and full color machines, and when the developing device is reduced in size for the purpose of reducing the size of the machine itself, the rotation speed of the magnet roller is required to be increased. In such cases, unpreferably the saturation magnetization less than 53 $Am^2/kg$ offers the cause for the carrier beads carry over, and the saturation magnetization exceeding 78 $Am^2/kg$ enables to suppress the carrier beads carry over, but makes the magnetic brush ears hard and thus makes it difficult to obtain satisfactory image quality.

When such resin-filled ferrite carrier as in the present invention is applied in such electrophotographic carriers, the resin filling offers advantages such that the specific gravity reduction is achieved and the durability is improved, but at the same time, the magnetization after the resin filling is decreased as compared to the magnetization of the ferrite core material before the resin filling. In view of this fact, for the purpose of achieving, after the resin filling, the above-described magnetization, the saturation magnetization of the porous ferrite particle according to the present invention preferably falls within the above-described range.

By using the porous ferrite particle falling within the above-described range, the saturation magnetization of the carrier after the resin filling is made to fall within a range from 53 to 78 $Am^2/kg$, preferably from 57 to 72 $Am^2/kg$ and most preferably from 60 to 70 $Am^2/kg$.

[Magnetic Properties]

The magnetization is measured with an integral-type B-H tracer, model BHU-60 (manufactured by Riken Denshi Co., Ltd.). An H coil for measuring magnetic field and a 4πI coil for measuring magnetization are inserted between the electromagnet pole pieces. In this case, a sample is placed in the 47πI coil. By integrating each of the outputs from the H coil and the 47πI coil while the magnetic field H is being varied by varying the current of the electromagnet, a hysteresis loop is depicted on a sheet of recording paper with the H output on the X-axis and the 47πI coil output on the Y-axis. Here, the measurement is performed under the following measurement conditions: the sample filling quantity: about 1 g; the sample filling cell: inner diameter: 7 mmϕ±0.02 mm and height: 10 mm±0.1 mm; 4πI coil: 30 turns.

The porous ferrite particle is preferably obtained by sintering (intermediate sintering) in a reductive atmosphere and by subsequent additional sintering (final sintering) in a reductive atmosphere or in an inert atmosphere.

The porous ferrite particle develops magnetization by performing sintering (intermediate sintering) in a reductive atmosphere. Then, by performing sintering (final sintering) in a reductive atmosphere or in an inert atmosphere, crystal growth proceeds while the developed magnetization is being maintained so as to fall within a certain range without being extremely decreased, and thus the intended porousness (pore volume, pore size) can be obtained.

Unpreferably, performing the intermediate sintering in an oxidative atmosphere disturbs the development of high magnetization. Also, performing the final sintering in an oxidative atmosphere promotes crystal growth, but at the same time, unpreferably decreases the magnetization.

The saturation magnetization of the porous ferrite particle before the step of final sintering is preferably 55 to 80 $Am^2/kg$ and the ratio to the saturation magnetization after the step of final sintering (the saturation magnetization before the step of final sintering/the saturation magnetization after the step of final sintering) is preferably 0.75 to 1.25, more preferably 0.85 to 1.15 and most preferably 0.90 to 1.10.

When this ratio is less than 0.75, it is meant that the decrease of the magnetization at the time of the final sintering is too large; there is a high possibility that the variation of the magnetization among particles occurs at the time of the final sintering, and unpreferably offered are causes for such carrier beads carry over as described above and other problems. When this ratio exceeds 1.25, the magnetization is increased, there is a possibility that the crystal growth proceeds to an excessive extent, and it comes to be difficult to obtain the intended porousness.

The pore volume of the porous ferrite particle before the step of final sintering is preferably 150 $mm^3/g$ or more and more preferably 150 to 350 $mm^3/g$. Additionally, the ratio to the pore volume after the step of final sintering (the pore volume before the step of final sintering/the pore volume after the step of final sintering) is preferably 1.2 to 6.0, more preferably 1.2 to 5.5 and most preferably 1.3 to 5.0.

When the pore volume of the porous ferrite particle before the step of final sintering is less than 150 $mm^3/g$, unpreferably the pore volume after the step of final sintering is too small.

Also, when the ratio to the pore volume after the step of final sintering is less than 1.2, it is meant that the crystal growth does not sufficiently proceed from the crystal growth before the final sintering; the intended porousness, in particular, the peak pore size is too small and unpreferably the resin filling is made difficult. When the ratio to the pore volume after the step of final sintering exceeds 6.0, it is meant that the crystal growth proceeds to an excessive extent; in addition to the fact that it is difficult to obtain the intended porousness, there is a high possibility that the among-particle variation of the porousness occurs, the among-particle variations of the particle density and the magnetization after the resin filling also occur, and unpreferably offered are causes for the degradation of the charging property and the carrier beads carry over.

The resin-filled carrier for an electrophotographic developer according to the present invention is obtained by filling a resin into a porous ferrite particle (carrier core material). The resin filling amount is preferably 6 to 20 parts by weight, more preferably 7 to 15 parts by weight and most preferably 7 to 12 parts by weight in relation to 100 parts by weight of the porous ferrite particle. When the resin filling amount is less than 6 parts by weight, no sufficient weight reduction can be achieved. When the resin filling amount exceeds 20 parts by weight, aggregated particles tend to occur at the time of filling to offer a cause for charge variation.

The filling resin is not particularly limited, and can be appropriately selected depending on the toner to be combined therewith, the use environment and the like. Examples of the filling resin include: fluororesins, acrylic resins, epoxy resins, polyamide resins, polyamideimide resins, polyester resins, unsaturated polyester resins, urea resins, melamine resins, alkyd resins, phenolic resins, fluoroacrylic resins, acryl-styrene resins and silicone resins; and modified silicone resins obtained by modification with a resin such as an acrylic resin, a polyester resin, an epoxy resin, a polyamide resin, a polyamideimide resin, an alkyd resin, a urethane resin, or a fluororesin. In consideration of the exfoliation of the resin due to the mechanical stress during use, thermosetting resins are preferably used. Specific examples of the thermosetting resins include epoxy resins, phenolic resins, silicone resins, unsaturated polyester resins, urea resins, melamine resins, alkyd resins and resins containing these resins.

Preferable among these resins are silicone resins. Examples of the silicone resins include methylsilicone resins, phenylsilicone resins and methylphenylsilicone resins; methylphenylsilicone resins are most preferably used.

For the purpose of controlling the electric resistance, the charge amount and the charging rate of the carrier, a conductive agent can be added in the filling resin. The electric resistance of the conductive agent itself is low, and hence when the addition amount of the conductive agent is too large, a rapid charge leakage tends to occur. Accordingly, the addition amount of the conductive agent is 0.25 to 20.0% by weight, preferably 0.5 to 15.0% by weight and particularly preferably 1.0 to 10.0% by weight in relation to the solid content of the filling resin. Examples of the conductive agent include conductive carbon, oxides such as titanium oxide and tin oxide, and various organic conductive agents.

Additionally, a charge controlling agent can be added in the filling resin. Examples of the charge controlling agent include various types of charge controlling agents generally used for toners and various types of silane coupling agents. This is because in a case where a large amount of a resin is filled, the charge imparting ability is degraded as the case may be, but the addition of various types of charge controlling agents and silane coupling agents enables the control of the degradation of the charge imparting ability. The usable types of the charge controlling agents and the silane coupling agents are not particularly limited; preferable examples of the usable charge controlling agents and silane coupling agents include: charge controlling agents such as nigrosine dyes, quaternary ammonium salts, organometallic complexes and metal-containing monoazo dyes; and aminosilane coupling agents and fluorosilane coupling agents.

In the resin-filled carrier for an electrophotographic developer according to the present invention, the surface thereof is preferably coated with a coating resin. The carrier properties, in particular, the electric properties including the charging property are frequently affected by the materials present on the carrier surface and by the properties and conditions of the carrier surface. Accordingly, by coating the surface of the carrier with an appropriate resin, intended carrier properties can be regulated with a satisfactory accuracy.

The coating resin is not particularly limited. Examples of the coating resin include: fluororesins, acrylic resins, epoxy resins, polyamide resins, polyamideimide resins, polyester resins, unsaturated polyester resins, urea resins, melamine resins, alkyd resins, phenolic resins, fluoroacrylic resins, acryl-styrene resins and silicone resins; and modified silicone resins obtained by modification with a resin such as an acrylic resin, a polyester resin, an epoxy resin, a polyamide resin, a polyamideimide resin, an alkyd resin, a urethane resin or a fluororesin. In consideration of the detachment of the resin due to the mechanical stress during use, thermosetting resins are preferably used. Specific examples of the thermosetting resins include epoxy resins, phenolic resins, silicone resins, unsaturated polyester resins, urea resins, melamine resins, alkyd resins and resins containing these resins. The coating amount of the resin is preferably 0.5 to 5.0 parts by weight in relation to 100 parts by weight of the resin-filled carrier (before resin coating).

These coating resins may also contain conductive agents and charge controlling agents, for the same purposes as described above. The types and the addition amounts of the conductive agents and the charge controlling agents are the same as in the above-described cases of the filling resin.

The volume average particle size of the resin-filled carrier for an electrophotographic developer according to the present invention is preferably 20 to 70 μm, more preferably 30 to 70 μm and most preferably 30 to 60 μm. With these ranges, the carrier beads carry over is prevented and satisfactory image quality is obtained. When the volume average particle size is less than 20 μm, unpreferably such a particle size offers a cause for the carrier beads carry over. When the volume average particle size exceeds 70 μm, unpreferably such a particle size offers a cause for the image quality degradation due to the degradation of the charge imparting ability.

[Volume Average Particle Size (Microtrac)]

The volume average particle size is measured as follows. Specifically, the volume average particle size is measured with Microtrac Particle Size Analyzer (model 9320-X100) manufactured by Nikkiso Co., Ltd. Water is used as a dispersion medium. In a 100-ml beaker, 10 g of a sample and 80 ml of water are placed, and a few drops of a dispersant (sodium hexametaphosphate) are added in the beaker. Next, the resulting mixture is subjected to dispersion for 20 seconds with an ultrasonic homogenizer (model UH-150, manufactured by SMT Co., Ltd.) set at an output power level of 4. Thereafter, the foam formed on the surface of the dispersed mixture in the beaker is removed and the dispersed mixture is placed in the measurement apparatus. The volume percentage of the particles of less than 24 μm, to be described later, is also measured in the same manner.

The particle density of the resin-filled carrier for an electrophotographic developer according to the present invention is preferably 3.5 to 4.3 g/cm$^3$ and more preferably 3.7 to 4.1 g/cm$^3$. When the particle density is less than 3.5 g/cm$^3$, the carrier is too light in weight and hence the charge imparting ability tends to be degraded. When the particle density exceeds 4.3 g/cm$^3$, the weight reduction of the carrier is insufficient and the carrier is poor in durability.

[Particle Density]

The particle density is measured as follows. Specifically, the particle density is measured in conformity with JIS R9301-2-1 by using a pycnometer. Here, the measurement is performed by using methanol as the solvent and at a temperature of 25° C.

The apparent density of the resin-filled carrier for an electrophotographic developer according to the present invention is preferably 1.0 to 2.2 g/cm$^3$, more preferably 1.0 to 2.0 g/cm$^3$ and most preferably 1.3 to 1.8 g/cm$^3$. When the apparent density is less than 1.0 g/cm$^3$, the carrier is too light in weight and hence the charge imparting ability tends to be degraded. When the apparent density exceeds 2.2 g/cm$^3$, the weight reduction of the carrier is insufficient and the carrier is poor in durability.

[Apparent Density]

The measurement of the apparent density is performed according to JIS-Z2504 (Test Method for Apparent Density of Metal Powders).

The proportion of the particles of less than 24 μm of the resin-filled carrier for an electrophotographic developer according to the present invention is preferably 5% by volume or less, more preferably 4% by volume or less and most preferably 3% by volume or less. When the proportion of the particles of less than 24 μm exceeds 5% by volume, unpreferably the carrier beads carry over tends to occur. This measurement method is the same as the above-described measurement method of the volume average particle size.

<Production Methods of the Resin-Filled Ferrite Carrier Core Material and the Ferrite Carrier for an Electrophotographic Developer According to the Present Invention>

The production methods of the resin-filled ferrite carrier core material and the ferrite carrier for an electrophotographic developer according to the present invention are described.

For the purpose of producing the resin-filled ferrite carrier core material (a porous ferrite particle) for an electrophotographic developer according to the present invention, first, raw materials are weighed out in appropriate amounts, and then pulverized and mixed with a ball mill, a vibration mill or the like for 0.5 hour or more, preferably, 1 to 20 hours. The raw materials are not particularly limited, but are preferably selected so as to give the composition containing the above-described elements.

The resulting pulverized mixture is converted into a pellet with a compression molding machine or the like, and then the pellet is calcined at a temperature of 600 to 1200° C. Without using a compression molding machine, after pulverization, the pulverized mixture may be converted into a slurry by adding water thereto, and the slurry may be converted into particles by using a spray dryer. After the calcination, further pulverization is performed with a ball mill, a vibration mill or the like, thereafter water and, where necessary, a dispersant, a binder and the like are added, the viscosity is adjusted, and then particles are prepared with a spray dryer for granulation. In the pulverization after the calcination, pulverization may also be performed by adding water with a wet ball mill, a wet vibration mill or the like.

The calcination is not necessarily required to be performed. In the cases of the nonporous ferrite particles used for common electrophotographic carriers, when no calcination is performed, closed pores tend to occur in the interior of the ferrite particles without continuation from the surface, and unpreferably the among-particle variations of the magnetization and the particle density tend to occur.

However, the case of such a porous ferrite particle as provided by the present invention is characterized in that sintering is performed at a low temperature for the purpose of obtaining the porousness and proactively pores are thus formed, and hence such problems as described above hardly occur in the concerned case.

The above-described pulverizing machine such as the ball mill or the vibration mill is not particularly limited; however, for the purpose of effectively and uniformly dispersing the raw materials, it is preferable to adopt fine beads having a particle size of 1 mm or less as the media to be used. By regulating the size and the composition of the beads used and the pulverization time, the degree of pulverization can be controlled.

Thereafter, the resulting granulated substance is heated at a temperature of about 400 to 800° C. to remove the organic components such as the added dispersant and the added binder. When the final sintering is performed with the remaining dispersant and the remaining binder as they are, the oxygen concentration inside the final sintering apparatus tends to vary due to the decomposition and oxidation of the organic components, and the magnetic properties are significantly affected, and hence it is difficult to perform the production stably. Additionally, these organic components offer the causes for varying the porousness control, namely, the crystal growth of the ferrite.

The porous ferrite particle of the present invention is preferably subjected to the intermediate sintering between the above-described step of removing the organic components and the below-described final sintering.

For the purpose of maintaining high magnetization in the ferrite composition of the porous ferrite particle according to the present invention while the porousness is being maintained, mainly the magnetization is increased in the intermediate sintering and mainly the porousness is regulated in the final sintering. By separating somewhat definitely in this way the properties to be developed in the respective sintering steps, the intended porous ferrite particle can be obtained.

Specifically, the particles having been subjected to the above-described step of removing the organic components is maintained in an inert atmosphere or in a reductive atmosphere for 1 to 10 hours by using a rotary electric furnace, a batch electric furnace, a continuous electric furnace or the like. In particular, it is preferable to use the reductive atmosphere; the reductive atmosphere is more capable of increasing the magnetization than the inert atmosphere.

For the inert atmosphere, nitrogen gas is used. For the reductive atmosphere, an appropriate atmosphere can be obtained by introducing CO gas, hydrogen gas or the like. Alternatively, by performing the intermediate sintering by mixing carbon black or a carbon-containing organic compound with the particles, the atmosphere inside the furnace can be converted into the reductive atmosphere through the utilization of the oxidation of the carbon.

The type of carbon black used in this case is not particularly limited; examples of the usable carbon black include furnace black, acetylene black and channel black. Additionally, examples of the usable carbon (C)-containing organic compound include: polyvinyl alcohol, polyvinylpyrrolidone, polyethylene glycol and polyolefins such as polyethylene, polymethyl methacrylate, polymethyl acrylate and polyesters; particularly preferable among these is polyvinyl alcohol although not particularly limited.

It is to be noted that such materials as described above, used for creating the reductive atmosphere are required to be decomposed and oxidized at the intermediate sintering temperature. When the decomposition temperature is too high, or when the intermediate sintering temperature is too low, no sufficiently reductive atmosphere can be obtained to fail to increase the magnetization.

The intermediate sintering temperature is varied depending on the involved conditions. When hydrogen gas is used, the intermediate sintering temperature may be a comparatively low temperature, and thus the intermediate sintering is performed at 250 to 800° C. When the intermediate sintering is performed by mixing carbon black or the carbon-containing organic compound, a temperature of about 600 to 1100° C. is required. However, sintering at a too high temperature increases the magnetization, but at the same time, crystal growth is promoted to make it difficult to obtain the intended porousness. On the other hand, sintering at a too low temperature, as described above, does not create the intended reductive atmosphere. Therefore, sintering is performed in a temperature range preferably from 650 to 1050° C. and more preferably 700 to 1000° C.

The addition amount of carbon black or the organic compound is preferably such that the atmosphere inside the furnace is sufficiently converted into a reductive atmosphere. When the addition amount is too small, ferritization (spinel formation) does not proceed sufficiently and hence the development of the magnetization is insufficient. When the addition amount is too large, the remaining amount of the carbon or the organic compound after the intermediate sintering is large, and unpreferably the control of the porousness to be performed in the final sintering is made difficult.

The addition amount of carbon black or the organic compound is varied depending on the types of the materials used or the ferrite composition (the mixing proportions of the individual metal compounds); when polyvinyl alcohol is used in the composition as described in the present invention, polyvinyl alcohol is preferably used in a range from 10 to 50 parts by weight and more preferably in a range from 15 to 40 parts by weight, in relation to 1000 parts by weight of the granulated substance.

The step of intermediate sintering can also be performed simultaneously with the above-described step of removing the organic components. The binder and the dispersant used in the granulation step are organic compounds, and it is possible to create the reductive atmosphere by the decomposition and the oxidation of these organic compounds. In this case, the amounts of the binder and the dispersant required for obtaining the intended reductive atmosphere are beforehand calculated, and the binder and the dispersant are added in the granulation step.

It is to be noted that addition of the dispersant and the binder in the granulation step to an excessive extent offers causes for the shape degradation of the obtained granulated substance and the formation of aggregates in a large amount, as the case may be. Therefore, when the addition amount required for obtaining the reductive atmosphere is too large, preferably the step of removing the organic components and the step of intermediate sintering are performed separately.

Although the magnetization is developed at the stage where the step of intermediate sintering has been completed, the intended porousness has not yet been obtained. Therefore, it is necessary to perform the final sintering for the purpose of obtaining the intended porousness by promoting the crystal growth while the magnetization obtained in the step of intermediate sintering is being maintained within a certain range without extremely degrading the magnetization obtained in the step of intermediate sintering. Specifically, the final sintering is performed by maintaining the ferrite particles in the atmosphere in which the oxygen concentration is controlled, at a temperature of 800 to 1500° C., for 1 to 24 hours. For the purpose of obtaining appropriate porousness and appropriate magnetization in the ferrite composition of the present invention, the sintering is performed at 900 to 1300° C., preferably at 950 to 1250° C. and most preferably at 1000 to 1200° C.

In the case where the final sintering temperature is lower than the intermediate sintering temperature, the crystal growth does not proceed, and hence the pore size is too small although the pore volume is high; thus, this case is unpreferable for the purpose of resin filling. In the case where the final sintering temperature is too high, the crystal growth proceeds to an excessive extent, and hence the porousness is lost.

Preferably, the final sintering temperature is at least the same temperature as the intermediate sintering temperature (when performed simultaneously with the step of removing the organic components, the simultaneous performing temperature), and is preferably higher by 50° C. or more and more preferably higher by 100° C. or more than the intermediate sintering temperature (when performed simultaneously with the step of removing the organic components, the simultaneous performing temperature).

In this case, a rotary electric furnace, a batch electric furnace, a continuous electric furnace or the like is used, and the atmosphere at the time of sintering may be subjected to an oxygen concentration control by introducing an inert gas such as nitrogen or a reductive gas such as hydrogen or carbon monoxide.

The resulting sintered substance is pulverized and classified. As the classification method, the existing methods such as a pneumatic classification method, a mesh filtration method and a precipitation method are used to regulate the particle size to an intended particle size.

Thereafter, where necessary, by applying low temperature heating to the surface, an oxide film forming treatment is performed and thus electric resistance can be regulated. In the oxide film forming treatment, a common rotary electric furnace, a common batch electric furnace or the like is used to allow the heat treatment to be performed, for example, at 300 to 700° C. The thickness of the oxide film formed by this treatment is preferably 0.1 nm to 5 μm. When the thickness is less than 0.1 nm, the effect of the oxide film layer is small, and when the thickness exceeds 5 μm, the magnetization is degraded or the resistance becomes too high, and thus unpreferably intended properties are hardly obtained. Where necessary, reduction may be performed before the oxide film forming treatment. In this way, a porous ferrite particle having a pore volume and a peak pore size respectively falling within specific ranges is prepared.

Examples of the practically applicable method for controlling the above-described variations of the pore volume, the peak pore size and the pore size of the porous ferrite particle (ferrite carrier core material) include various methods based on the types of the raw material to be mixed, the pulverization degree of the raw materials, application or nonapplication of calcination, the calcination temperature, the calcination time, the binder amount at the time of granulation by a spray dryer, the sintering method, the sintering temperature, the sintering time and the sintering atmosphere (such as reduction with a gas such as nitrogen gas, hydrogen gas and carbon monoxide gas; oxidation with oxygen). These controlling methods are not particularly limited; an example of these methods is described below.

Specifically, the use of hydroxide or carbonate as the raw materials to be mixed tends to result in a larger pore volume than the use of oxide; additionally, nonapplication of calcination or a low calcination temperature or a combination of a low final sintering temperature and a short sintering time tends to result in a large pore volume.

Further, by varying the temperature increase rate or the cooling rate in the final sintering, the distribution of the pore volume or the pore size can be varied; a fast temperature increase rate tends to result in a large pore volume, and a slow cooling rate tends to result in a narrow pore size distribution probably because of uniformization of the crystal growth.

The peak pore size tends to be small under the conditions that the pulverization degree of the raw materials used, in particular, the pulverization degree of the raw materials after calcination is enhanced and thus the primary particle size in pulverization is made small. The peak pore size can be made small by the introduction of a reductive gas such as hydrogen or carbon monoxide, rather than the use of an inert gas such as nitrogen at the time of the final sintering.

Further, the pore size variation can be reduced by enhancing the pulverization degree of the raw materials used, in particular, the raw materials after calcination and by thus sharpening the pulverized particle size distribution.

The step of intermediate sintering can also regulate the pore volume and the pore size. When the amount of carbon black or the organic compound added at the time of the intermediate sintering is too large, the crystal growth proceeds to an excessive extent in the step of final sintering, and hence the pore volume is made small. Additionally, when the intermediate sintering temperature is low and differs largely from the final sintering temperature, the pore size tends to be large.

By using these controlling methods each alone or in combinations, a porous ferrite particle having the intended variations of the pore volume, the intended peak pore size and the intended pore size can be obtained.

The resin-filled ferrite carrier for an electrophotographic developer according to the present invention is obtained by filling a resin into the carrier core material (porous ferrite particle). As the filling method, various methods are available. Examples of the filling method include: a dry method, a spray drying method based on a fluidized bed, a rotary drying method and a dip-and-dry method using a universal stirrer or the like. The resins to be used herein are as described above.

In the step of filling the resin, it is preferable to fill the resin in the pores of the porous ferrite particles while the porous ferrite particles and the filling resin are being mixed under stirring under reduced pressure. Such filing of the resin under reduced pressure enables to efficiently fill the resin in the pores. The degree of the pressure reduction is preferably such that the pressure falls in the range from 1.3 to 93 kPa (about 10 to 700 mmHg). When the pressure exceeds 93 kPa (about 700 mmHg), no effect of the pressure reduction is attained, and when the pressure is less than 1.3 kPa (about 10 mmHg), the resin solution tends to boil during the filling step so as to inhibit efficient filling.

The resin-filling step can be performed as a plurality of divided steps. However, it is also possible to fill the resin in one resin-filling step. Thus, it is not necessary to dare to divide the filling step into a plurality of steps. However, depending on the type of the resin, an attempt to fill a large amount of the resin at a time leads to the occurrence of the aggregation of particles as the case may be. When the carrier is used in a developing device, such aggregation of particles undergoes disintegration due to the stirring stress in the developing device as the case may be. The interface in the aggregated particles is largely different in the charging property, and hence unpreferably the charge variation occurs during passage of time. In such a case, the filling step divided into a plurality of steps enables to perform the filling in a just enough manner while the aggregation is being prevented.

After the filling of the resin, where necessary, heating is performed with various methods, so as to make the filled resin adhere to the core material. The heating method may be either an external heating method or an internal heating method; for example, a fixed electric furnace, a fluid-type electric furnace, a rotary electric furnace or a burner furnace may be used, or baking with microwave may also be adopted. The heating temperature is varied depending on the filing resin; the heating temperature is required to be a temperature equal to or higher than the melting point or the glass transition point; when a thermosetting resin, a condensation-crosslinking resin or the like is used, by increasing the heating temperature to a temperature allowing the curing to sufficiently proceed, a resin-filled carrier that has resistance against impact can be obtained.

After the resin has been filled in the porous ferrite particle as described above, the surface of the porous ferrite particle is preferably coated with a resin. The carrier properties, in particular, the electric properties including the charging property are frequently affected by the materials present on the carrier surface and by the properties and conditions of the carrier surface. Accordingly, by coating the surface of the porous ferrite particle with an appropriate resin, intended carrier properties can be regulated with a satisfactory accuracy. As the method for coating, heretofore known methods such as a brush coating method, a dry method, a spray drying method based on a fluidized bed, a rotary drying method and a dip-and-dry method using a universal stirrer can be applied for coating. In consideration of the toner to be combined and the structure of the device in which the developer is used, the method based on a fluidized bed is preferable when it is necessary to improve the coverage factor. When baking is performed after the resin coating, either an external heating method or an internal heating method may be used; for example, a fixed electric furnace, a fluid-type electric furnace, a rotary electric furnace or a burner furnace may be used, or baking with microwave may also be adopted. When a UV curable resin is used, a UV heater is used. The baking temperature is varied depending on the resin used; the baking temperature is required to be a temperature equal to or higher than the melting point or the glass transition point; when a thermosetting resin, a condensation-crosslinking resin or the like is used, the baking temperature is required to be increased to a temperature allowing the curing to proceed sufficiently.

<Electrophotographic Developer According to the Present Invention>

Next, the electrophotographic developer according to the present invention is described.

The electrophotographic developer according to the present invention is composed of the above-described resin-filled ferrite carrier for an electrophotographic developer and a toner.

Examples of the toner particle that constitutes the electrophotographic developer of the present invention include a pulverized toner particle produced by a pulverization method and a polymerized toner particle produced by a polymerization method. In the present invention, the toner particle obtained by either of these methods can be used.

The pulverized toner particle can be obtained, for example, by means of a method in which a binder resin, a charge controlling agent and a colorant are fully mixed with a mixing machine such as a Henschel mixer, then the resulting mixture is melt-kneaded with an apparatus such as a double screw extruder, and the melt-kneaded mixture is cooled, pulverized and classified; an external additive is added to the resulting classified particle, and then the resulting mixture is mixed with a mixing machine such as a mixer to yield the pulverized toner particle.

The binder resin that constitutes the pulverized toner particle is not particularly limited. However, examples of the binder resin may include polystyrene, chloropolystyrene, styrene-chlorostyrene copolymer, styrene-acrylate copolymer and styrene-methacrylic acid copolymer, and further, rosin-modified maleic acid resin, epoxy resin, polyester resin and polyurethane resin. These binder resins are used each alone or as mixtures thereof.

As the charge controlling agent, any charge controlling agent can be used. Examples of the charge controlling agent for use in positively charged toners may include nigrosine dyes and quaternary ammonium salts. Additionally, examples of the charge controlling agent for use in negatively charged toners may include metal-containing monoazo dyes.

As the colorant (coloring material), hitherto known dyes and pigments can be used. Examples of the usable colorant include carbon black, phthalocyanine blue, permanent red, chrome yellow and phthalocyanine green. Additionally, for the purpose of improving the fluidity and the anti-aggregation property of the toner, external additives such as a silica powder and titania can be added to the toner particle according to the toner particle.

The polymerized toner particle is a toner particle produced by heretofore known methods such as a suspension polymerization method, an emulsion polymerization method, an emulsion aggregation method, an ester extension polymerization method and a phase inversion emulsion method. Such a polymerized toner particle can be obtained, for example, as follows: a colorant dispersion liquid in which a colorant is dispersed in water with a surfactant, a polymerizable monomer, a surfactant and a polymerization initiator are mixed in a aqueous medium under stirring to disperse the polymerizable monomer by emulsification in the aqueous medium; the polymerizable monomer thus dispersed is polymerized under stirring for mixing; thereafter, the polymer particles are salted out by adding a salting-out agent; the particles obtained by salting-out are filtered off, rinsed and dried, and thus the polymerized toner particle can be obtained. Thereafter, where necessary, an external additive is added to the dried toner particle.

Further, when the polymerized toner particle is produced, in addition to the polymerizable monomer, the surfactant, the polymerization initiator and the colorant, a fixability improving agent and a charge controlling agent can also be mixed; the various properties of the obtained polymerized toner particle can be controlled and improved by these agents. Additionally, a chain transfer agent can also be used for the purpose of improving the dispersibility of the polymerizable monomer in the aqueous medium and regulating the molecular weight of the obtained polymer.

The polymerizable monomer used in the production of the polymerized toner particle is not particularly limited. However, example of such a polymerizable monomer may include: styrene and the derivatives thereof; ethylenically unsaturated monoolefins such as ethylene and propylene; vinyl halides such as vinyl chloride; vinyl esters such as vinyl acetate; and α-methylene aliphatic monocarboxylic acid esters such as methyl acrylate, ethyl acrylate, methyl methacrylate, ethyl methacrylate, 2-ethylhexyl methacrylate, acrylic acid dimethylamino ester and methacrylic acid diethylamino ester.

As the colorant (coloring material) used when the polymerized toner particle is prepared, hitherto known dyes and pigments can be used. Examples of the usable colorant include carbon black, phthalocyanine blue, permanent red, chrome yellow and phthalocyanine green. Additionally, the surface of each of these colorants may be modified by using a silane coupling agent, a titanium coupling agent or the like.

As the surfactant used in the production of the polymerized toner particle, anionic surfactants, cationic surfactants, amphoteric surfactants and nonionic surfactants can be used.

Here, examples of the anionic surfactants may include: fatty acid salts such as sodium oleate and castor oil; alkyl sulfates such as sodium lauryl sulfate and ammonium lauryl sulfate; alkylbenzenesulfonates such as sodium dodecylbenzenesulfonate; alkylnaphthalenesulfonates; alkylphosphoric acid ester salts; naphthalenesulfonic acid-formalin condensate; and polyoxyethylene alkyl sulfuric acid ester salts. Additionally, examples of the nonionic surfactants may include: polyoxyethylene alkyl ethers, polyoxyethylene fatty acid esters, sorbitan fatty acid esters, polyoxyethylene alkylamines, glycerin, fatty acid esters and oxyethylene-oxypropylene block polymer. Further, examples of the cationic surfactants may include: alkylamine salts such as laurylamine acetate; and quaternary ammonium salts such as lauryltrimethylammonium chloride and stearyltrimethylammonium chloride. Additionally, examples of the amphoteric surfactants may include aminocarboxylic acid salts and alkylamino acids.

The above-described surfactants can each be used usually in a range from 0.01 to 10% by weight in relation to the polymerizable monomer. The used amount of such a surfactant affects the dispersion stability of the monomer, and also affects the environment dependence of the obtained polymerized toner particle, and hence such a surfactant is preferably used within the above-described range in which the dispersion stability of the monomer is ensured and the environment dependence of the polymerized toner particle is hardly excessively affected.

For the production of the polymerized toner particle, usually a polymerization initiator is used. Examples of the polymerization initiator include water-soluble polymerization initiators and oil-soluble polymerization initiators. In the present invention, either of a water-soluble polymerization initiator and an oil-soluble polymerization initiator can be used. Examples of the water-soluble polymerization initiator usable in the present invention may include: persulfates such as potassium persulfate and ammonium persulfate; and water-soluble peroxide compounds. Additionally, examples of the oil-soluble polymerization initiator usable in the present invention may include: azo compounds such as azobisisobutyronitrile; and oil-soluble peroxide compounds.

Additionally, for a case where a chain transfer agent is used in the present invention, examples of the chain transfer agent may include: mercaptans such as octylmercaptan, dodecylmercaptan and tert-dodecylmercaptan; and carbon tetrabromide.

Further, for a case where the polymerized toner particle used in the present invention contains a fixability improving agent, examples of the usable fixability improving agent include: natural waxes such as carnauba wax; and olefin waxes such as polypropylene wax and polyethylene wax.

Additionally, for a case where the polymerized toner particle used in the present invention contains a charge controlling agent, the charge controlling agent used is not particularly limited, and examples of the usable charge controlling agent include nigrosine dyes, quaternary ammonium salts, organometallic complexes and metal-containing monoazo dyes.

Additionally, examples of the external additives used for improving the fluidity and the like of the polymerized toner particle may include silica, titanium oxide, barium titanate, fluororesin fine particles and acrylic resin fine particles. These external additives can be used each alone or in combinations thereof.

Further, examples of the salting-out agent used for separation of the polymerized particles from the aqueous medium may include metal salts such as magnesium sulfate, aluminum sulfate, barium chloride, magnesium chloride, calcium chloride and sodium chloride.

The average particle size of the toner particle produced as described above falls in a range from 2 to 15 μm and preferably in a range from 3 to 10 μm, and the polymerized toner particle is higher in the particle uniformity than the pulverized toner particle. When the average particle size of the toner particle is less than 2 μm, the charging ability is degraded to tend to cause fogging or toner scattering; when larger than 15 μm, such a particle size offers a cause for image quality degradation.

Mixing of the carrier and the toner produced as described above can yield an electrophotographic developer. The mixing ratio (the weight of the toner/(the weight of the carrier+the weight of the toner)) between the carrier and the toner, namely, the toner concentration is preferably set at 3 to 15% by weight. When the toner concentration is less than 3% by weight, it is difficult to attain an intended image density; when larger than 15% by weight, toner scattering or fogging tends to occur.

The electrophotographic developer according to the present invention can also be used as a refill developer. In this case, the mixing ratio (the weight of the toner/(the weight of the carrier+the weight of the toner)) between the carrier and the toner, namely, the toner concentration is preferably set at 50 to 95% by weight.

The electrophotographic developer according to the present invention, prepared as described above, can be used in a digital image formation apparatus, such as a copying machine, a printer, a FAX machine or a printing machine, adopting a development method in which an electrostatic latent image formed on a latent image holder having an organic photoconductor layer is reversely developed, while applying a bias electric field, with a magnetic brush of a two-component developer having a toner and a carrier. Additionally, the electrophotographic developer according to the present invention is also applicable to an image formation apparatus, such as a full-color machine, which adopts a method applying an alternating electric field composed of a DC bias and an AC bias superposed on the DC bias when a development bias is applied from the magnetic brush to the electrostatic latent image.

Hereinafter, the present invention is specifically described on the basis of Examples and others.

Example 1

$Fe_2O_3$: 930 parts by weight, $Mg(OH)_2$: 60 parts by weight and $SrCO_3$: 5 parts by weight were mixed and pulverized with a dry media mill (vibration mill, stainless steel beads of ⅛ inch in diameter) for 5 hours, and the pulverized substance thus obtained was converted into about 1-mm cube pellets with a roller compactor. The pellets were subjected to coarse powder removal with a vibration sieve of 3 mm in mesh opening size, and then subjected to fine powder removal with a vibration sieve of 0.5 mm in mesh opening size. Thereafter, the pellets were heated in the air for calcination at 800° C. for 3 hours with a rotary electric furnace. Then, the pellets were pulverized to an average particle size of 5 μm or less with a dry media mill (vibration mill, stainless steel beads of ⅛ inch in diameter). Then, water was added to the pulverized pellets to regulate so as for the solid content to be about 50% by weight, and then the resulting mixture was pulverized for 1 hour with a wet media mill (upright bead mill, stainless steel beads of 1/16 inch in diameter). The particle size (primary particle size of the pulverized substance) of the slurry thus obtained was measured with Microtrac, and consequently the $D_{50}$ was found to be 1.8 Rm. An appropriate amount of a dispersant was added to the slurry, and for the purpose of obtaining an appropriate pore volume, PVA (10% solution) as a binder was added to the slurry in an amount of 0.4% by weight in relation to the solid content of the slurry. Then, the resulting slurry was granulated and dried with a spray dryer. The obtained particles (granulated substance) were regulated in particle size, and then heated in the air at 650° C. for 2 hours with a rotary electric furnace to remove the organic components such as the dispersant and the binder.

Polyvinyl alcohol (powder) was added in an amount of 25 parts by weight (2.5% by weight) to 1000 parts by weight of the obtained particles, and the resulting mixture was fully mixed with a horizontally rotating mixing mill. The resulting mixture was subjected to a sintering (intermediate sintering) with a rotary furnace in a reductive atmosphere at 950° C. for about 2 hours.

Then, the intermediately sintered mixture was maintained at a sintering temperature of 1100° C. for 5 hours in an atmosphere of nitrogen gas with a tunnel electric furnace. In this case the temperature increase rate was set at 150° C./hr and the cooling rate was set at 110° C./hr. Subsequently, the sintered mixture was disintegrated and further classified to regulate the particle size, and subjected to separation and removal of low magnetic fractions with magnetic separation to yield porous ferrite particles (a ferrite carrier core material).

In the above-described mixing, the composition was such that approximately x=15 mol % and y=85 mol % in the ferrite composition, $(MgO)_x(Fe_2O_3)_y$, and part of the composition was replaced with 0.5 mol % of SrO.

Example 2

The final sintering temperature was set at 1050° C. Otherwise in the same manner as in Example 1, a porous ferrite particle (ferrite carrier core material) was obtained.

Example 3

The calcination temperature was set at 700° C. and the final sintering temperature was set at 1000° C. Otherwise in the same manner as in Example 1, a porous ferrite particle (ferrite carrier core material) was obtained.

Example 4

The amount of polyvinyl alcohol (powder) added to the resulting mixture at the time of the intermediate sintering was set at 3.5% by weight, the intermediate sintering temperature was set at 750° C. and the final sintering temperature was set at 1150° C. Otherwise in the same manner as in Example 3, a porous ferrite particle (ferrite carrier core material) was obtained.

Example 5

The final sintering temperature was set at 1100° C. Otherwise in the same manner as in Example 4, a porous ferrite particle (ferrite carrier core material) was obtained.

Example 6

$Fe_2O_3$: 907 parts by weight, $Mg(OH)_2$: 83 parts by weight and $SrCO_3$: 5 parts by weight were mixed in such a way that approximately x=20 mol % and y=80 mol % in the ferrite composition $(MgO)_x(Fe_2O_3)_y$, and part of the composition was replaced with 0.5 mol % of SrO. The amount of polyvinyl alcohol (powder) added to the resulting mixture at the time of the intermediate sintering was set at 2.0% by weight and the final sintering temperature was set at 1100° C. Otherwise in the same manner as in Example 1, a porous ferrite particle (ferrite carrier core material) was obtained.

Example 7

The final sintering temperature was set at 1050° C. Otherwise in the same manner as in Example 6, a porous ferrite particle (ferrite carrier core material) was obtained.

Example 8

$Fe_2O_3$: 939 parts by weight, $Mg(OH)_2$: 51 parts by weight and $SrCO_3$: 5 parts by weight were mixed in such a way that approximately x=13 mol % and y=87 mol % in the ferrite composition $(MgO)_x(Fe_2O_3)_y$, and part of the composition was replaced with 0.5 mol % of SrO. Otherwise in the same manner as in Example 2, a porous ferrite particle (ferrite carrier core material) was obtained.

Example 9

$Fe_2O_3$: 892 parts by weight, $Mg(OH)_2$: 97 parts by weight and $SrCO_3$: 5 parts by weight were mixed in such a way that approximately x=23 mol % and y=77 mol % in the ferrite composition $(MgO)_x(Fe_2O_3)_y$, and part of the composition was replaced with 0.5 mol % of SrO. Otherwise in the same manner as in Example 2, a porous ferrite particle (ferrite carrier core material) was obtained.

Example 10

The replacement amount of SrO was set at 0.1 mol %. Otherwise in the same manner as in Example 2, a porous ferrite particle (ferrite carrier core material) was obtained.

Example 11

The replacement amount of SrO was set at 2.5 mol %. Otherwise in the same manner as in Example 2, a porous ferrite particle (ferrite carrier core material) was obtained.

Comparative example 1

$Fe_2O_3$: 855 parts by weight, $Mg(OH)_2$: 134 parts by weight and $SrCO_3$: 6 parts by weight were mixed in such a way that approximately x=30 mol % and y=70 mol % in the ferrite composition $(MgO)_x(Fe_2O_3)_y$, and part of the composition was replaced with 0.5 mol % of SrO. The amount of polyvinyl alcohol (powder) added to the resulting mixture at the time of the intermediate sintering was set at 1.5% by weight and the final sintering temperature was set at 1210° C. Otherwise in the same manner as in Example 1, a porous ferrite particle (ferrite carrier core material) was obtained.

Comparative Example 2

The final sintering temperature was set at 1150° C. Otherwise in the same manner as in Comparative Example 1, a porous ferrite particle (ferrite carrier core material) was obtained.

Comparative Example 3

No calcination and no step of removing the organic components were performed, and in the intermediate sintering, sintering was performed without using any additive, at 1050° C. in air atmosphere. Otherwise in the same manner as in Comparative Example 1, a porous ferrite particle (ferrite carrier core material) was obtained.

Comparative Example 4

The final sintering temperature was set at 1180° C. Otherwise in the same manner as in Comparative Example 3, a porous ferrite particle (ferrite carrier core material) was obtained.

Comparative Example 5

The final sintering temperature was set at 1150° C. Otherwise in the same manner as in Comparative Example 3, a porous ferrite particle (ferrite carrier core material) was obtained.

Referential Example

As compared to Example 1, $MnCO_3$ was used in place of $Mg(OH)_2$, and the raw materials were weighed out in such a way that approximately x=20 mol % and y=80 mol % in $(MnO)_x(Fe_2O_3)_y$. Here, no replacement with SrO was performed.

The raw materials were mixed as described above, the resulting mixture is pulverized with a dry media mill (vibration mill, stainless steel beads of ⅛ inch in diameter) for 5 hours, and the pulverized substance thus obtained was converted into about 1-mm cube pellets with a roller compactor. The pellets were subjected to coarse powder removal with a vibration sieve of 3 mm in mesh opening size, and then subjected to fine powder removal with a vibration sieve of 0.5 mm in mesh opening size. Thereafter, the pellets were heated in the air for calcination at 900° C. for 3 hours with a rotary electric furnace.

Then, the pellets were pulverized to an average particle size of 5 μm or less with a dry media mill (vibration mill, stainless steel beads of ⅛ inch in diameter). Then, water was added to the pulverized pellets to regulate so as for the solid content to be about 50% by weight, and then the resulting mixture was pulverized for 1 hour with a wet media mill (upright bead mill, stainless steel beads of 1/16 inch in diameter). An appropriate amount of a dispersant was added to the slurry, and for the purpose of obtaining an appropriate pore volume, PVA (10% solution) as a binder was added to the slurry in an amount of 0.4% by weight in relation to the solid content of the slurry. Then, the resulting slurry was granulated and dried with a spray dryer. The obtained particles (granulated substance) were regulated in particle size, and then heated at 700° C. for 2 hours with a rotary electric furnace to remove the organic components such as the dispersant and the binder.

The granulated substance obtained as described above was maintained for sintering at a temperature of 900° C. for 1 hour with a rotary electric furnace. In this case, hydrogen gas was introduced into the furnace and the atmosphere inside the furnace was converted into a reductive atmosphere.

Then, the thus treated granulated substance was maintained at a sintering temperature of 1100° C. for 5 hours in an atmosphere of nitrogen gas with a tunnel electric furnace. Subsequently, the sintered granulated substance was disintegrated and further classified to regulate the particle size, and subjected to separation and removal of low magnetic fractions with magnetic separation to yield porous ferrite particles (a ferrite carrier core material).

Example 12

As the ferrite carrier core material, the porous ferrite particle obtained in Example 2 was used.

As the resin to be filled in the voids of the porous ferrite, prepared was the methyl phenyl silicone in which the molar ratio of phenyl/methyl was 0.63, the differential molecular weight curve had peaks at 630 and 2400, the number average molecular weight was 1704, the weight average molecular weight was 5510, the Z-average molecular weight was 16190, and the ratio of the number average molecular weight/the weight average molecular weight was 3.234. To 45 parts by weight of a solution of the silicone resin (the resin solution concentration was 20% by weight, and hence the solid content was 9 parts by weight; dilution solvent: toluene), an aminosilane coupling agent (γ-aminopropyltrimethoxysilane) was added in an amount of 10% by weight in relation to the resin solid content to yield a resin solution. The resin solution and 100 parts by weight of the porous ferrite particle obtained in Example 2 were mixed under stirring at 60° C. under a reduced pressure of 6.7 kPa (about 50 mmHg), and thus the resin was made to penetrate into and fill in the voids of the porous ferrite particle while the toluene was being evaporated.

The pressure inside the vessel was made to get back to normal pressure, the sufficient evaporation of the toluene was made sure of, and then the interior of the stirrer was visually observed to find that the particles no wet feeling was found and the fluidity was very satisfactory. Under continuous stirring under normal pressure, the heating medium temperature was increased to 220° C. at a temperature increase rate of 2° C./rain. At this temperature, heating under stirring was performed for 60 minutes to cure the resin.

Then, the particles were cooled down to room temperature, and the porous ferrite particles in which the resin was filled and cured were taken out, the aggregation of the particles was disintegrated with a vibration sieve of 150M in mesh opening, and the nonmagnetic fractions were removed with a magnetic separator. Successively, the coarse particles were removed, again with a vibration sieve, to yield a resin-filled ferrite particle (resin-filled ferrite carrier).

A silicone resin (the product name: SR-2411, manufactured by Dow Corning Toray Co., Ltd.) having a solid content of 20% by weight was prepared. A resin solution was prepared by mixing 50 parts by weight (10 parts by weight in terms of the solid content) of the above-described silicone resin and a aminosilane coupling agent (γ-aminopropyltrimethoxysilane) in an amount of 10% by weight in relation to the resin solid content in 50 parts by weight of toluene.

In a universal mixing stirrer, 1000 parts by weight of the obtained resin-filled ferrite particle was placed, the above-described resin solution was added and the resin coating was performed by the dip-and-dry method.

Then, the temperature was increased to 200° C., and stirring was performed for 2 hours to cure the resin.

Then, the ferrite particles on which the resin was coated and cured were taken out, the aggregation of the particles was disintegrated with a vibration sieve of 150M in mesh opening, and the nonmagnetic fractions were removed with a magnetic separator. Successively, the coarse particles were removed, again with a vibration sieve, to yield a resin-filled ferrite particle the surface of which was coated with a resin.

Example 13

As the ferrite carrier core material, the porous ferrite particle obtained in Example 3 was used. The resin filling amount was set at 13 parts by weight in terms of the resin solid content in relation to the 100 parts by weight of the porous ferrite particle. Otherwise in the same manner as in Example 12, the resin filling was performed and further, in the same manner as in Example 12, the resin coating was performed to yield a resin-filled ferrite carrier the surface of which was coated with a resin.

Comparative Example 6

As the ferrite carrier core material, the porous ferrite particle obtained in Comparative Example 3 was used. The resin filling amount was set at 4 parts by weight in terms of the resin solid content in relation to the 100 parts by weight of the porous ferrite particle. Otherwise in the same manner as in Example 12, the resin filling was performed and further, in the same manner as in Example 12, the resin coating was performed to yield a resin-filled ferrite carrier the surface of which was coated with a resin.

For each of the porous ferrite particles (ferrite carrier core materials) of Examples 1 to 11, Comparative Examples 1 to 5 and Referential Example, Table 1 shows the fundamental composition, the replacement amount of SrO, the calcination conditions (temperature, atmosphere), the conditions (temperature, atmosphere) of the step of removing the organic components, the intermediate sintering conditions (temperature, additive, addition amount, atmosphere) and the final sintering conditions (temperature, atmosphere). Additionally, for each of the porous ferrite particles of Examples 1 to 11, Comparative Examples 1 to 5 and Referential Example, Table 2 shows the properties (saturation magnetization and pore volume) before the final sintering and the properties (magnetization, saturation magnetization, remnant magnetization, coercive force, pore volume, peak pore size, dv value, electric resistances at 50 V and at 100 V, volume average particle size and apparent density) after the final sintering. The measurement methods of the properties of these porous ferrite particles are as described above. Further, for each of the porous ferrite particles of Examples 1 to 11, Comparative Examples 1 to 5 and Referential Example, Table 3 shows the saturation magnetization ratio (before final sintering/after final sintering) and the pore volume ratio (before final sintering/after final sintering).

Figure 2:
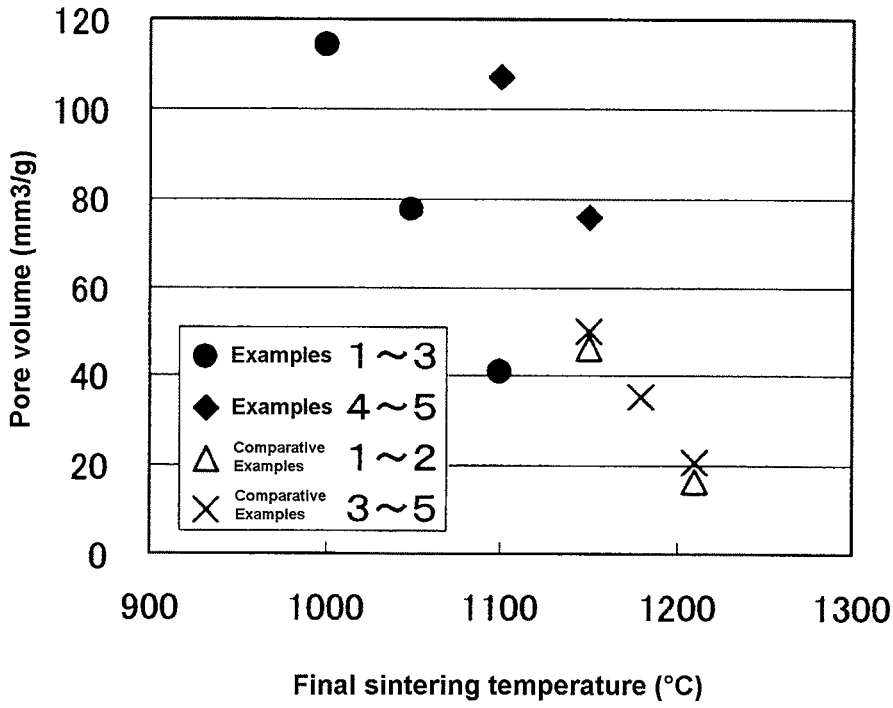
FIG. 2 is a graph showing the relation between the final sintering temperature and the pore volume in the porous ferrite particles of Examples 1 to 5 and Comparative Example 1 to 5.

For the porous ferrite particles of Examples 1 to 5 and Comparative Examples 1 to 5, FIG. 1 shows the relation between the final sintering temperature and the saturation magnetization and FIG. 2 shows the relation between the final sintering temperature and the pore volume.

For each of the ferrite carriers of Examples 12 and 13 and Comparative Example 6, Table 4 shows the porous ferrite particle used, the resin filling amount, the resin coating amount and the carrier properties (saturation magnetization, volume average particle size, particles of less than 24 μm, apparent density, particle density, initial and after-stirring charge amounts, charge amount variation) and the evaluation (weight reduction, magnetic property and charging properties). The charge amounts of these ferrite carriers were measured as follows. The measurement methods of the other properties are as described above.

(Charge Amount)

The charge amount was obtained from the measurement of a mixture composed of a carrier and a toner with a suction-type charge amount measurement apparatus (Epping q/m-meter, manufactured by PES-Laboratorium). The toner used was a commercially available negatively polar toner (cyan toner for use in DocuPrintC3530, manufactured by Fuji Xerox Co., Ltd., average particle size: about 5.8 μm) used in a full-color printer, and the toner concentration was regulated to be 5% by weight. The thus prepared developer was placed in a 50-cc glass bottle and stirred at a rotation number of 100 rpm, and the initial charge amount and the charge amount after 60-minute stirring were measured.

The evaluation was performed on the weight reduction, the magnetic property, the charging property A and the charging property B. The weight reduction was evaluated on the basis of the particle density and the magnetic properties were evaluated on the basis of the saturation magnetization. The charging property A was evaluated on the basis of the initial charge amount and the charging property B was evaluated on the basis of the charge amount variation. The evaluation was performed on the basis of the following four grades: A: excellent, B: good, C: average, D: poor. Specifically, the evaluation was performed as follows.

[Weight Reduction (Particle Density)]

A: 3.70 g/cm$^3$ to 4.10 g/cm$^3$

B: 3.50 g/cm$^3$ to less than 3.70 g/cm$^3$ or more than 4.10 g/cm$^3$ to 4.30 g/cm$^3$ C: 3.30 g/cm$^3$ to less than 3.50 g/cm$^3$ or more than 4.30 g/cm$^3$ to 4.50 g/cm$^3$ D: less than 3.30 g/cm$^3$ or more than 4.50 g/cm$^3$

[Magnetic Property (Saturation Magnetization)]

A: 60 Am$^2$/kg to 70 Am$^2$/kg

B: 57 Am$^2$/kg to less than 60 Am$^2$/kg or more than 70 Am$^2$/kg to 72 Am$^2$/kg C: 53 Am$^2$/kg to less than 57 Am$^2$/kg or more than 72 Am$^2$/kg to 78 Am$^2$/kg D: less than 53 Am$^2$/kg or more than 78 Am$^2$/kg

[Charging Property A (Initial Value)]

A: 55.0 μC/g or more

B: 40.0 μC/g to less than 55.0 μC/g

C: 30.0 μC/g to less than 40.0 μC/g

D: less than 30.0 μC/g

[Charging Property B (Charge Amount Variation)]

A: 3.0 or less

B: more than 3.0 to 5.0

C: more than 5.0 to 7.0

D: more than 7.0

TABLE 1

| Example/ Comparative Example | Composition (*1) | | | Calcination | | Removal of organic components | |
|---|---|---|---|---|---|---|---|
| | Mgo mol % | $Fe_2O_3$ mol % | SrO mol % | Temperature ° C. | Atmosphere (*2) | Temperature ° C. | Atmosphere (*2) |
| Example 1 | 14.9 | 84.6 | 0.5 | 800 | Air | 650 | Air |
| Example 2 | 14.9 | 84.6 | 0.5 | 800 | Air | 650 | Air |
| Example 3 | 14.9 | 84.6 | 0.5 | 700 | Air | 650 | Air |
| Example 4 | 14.9 | 84.6 | 0.5 | 700 | Air | 650 | Air |
| Example 5 | 14.9 | 84.6 | 0.5 | 700 | Air | 650 | Air |
| Example 6 | 19.9 | 79.6 | 0.5 | 700 | Air | 650 | Air |
| Example 7 | 19.9 | 79.6 | 0.5 | 700 | Air | 650 | Air |
| Example 8 | 12.9 | 86.6 | 0.5 | 800 | Air | 650 | Air |
| Example 9 | 22.9 | 76.6 | 0.5 | 800 | Air | 650 | Air |
| Example 10 | 15.0 | 84.9 | 0.1 | 800 | Air | 650 | Air |
| Example 11 | 14.6 | 82.8 | 2.5 | 800 | Air | 650 | Air |
| Comparative Example 1 | 29.8 | 69.7 | 0.5 | 700 | Air | 650 | Air |
| Comparative Example 2 | 29.8 | 69.7 | 0.5 | 700 | Air | 650 | Air |
| Comparative Example 3 | 29.8 | 69.7 | 0.5 | — | — | — | — |
| Comparative Example 4 | 29.8 | 69.7 | 0.5 | — | — | — | — |
| Comparative Example 5 | 29.8 | 69.7 | 0.5 | — | — | — | — |
| Referential Example | 20 (*3) | 80 | — | 900 | Air | 700 | Air |

| Example/ Comparative Example | Intermediate sintering | | | | Final sintering | |
|---|---|---|---|---|---|---|
| | Temperature ° C. | Additive | Addition amount wt % | Atmosphere | Temperature ° C. | Atmosphere (*2) |
| Example 1 | 950 | PVA | 2.5 | Reductive atmosphere | 1100 | Nitrogen (oxygen concentration: 0%) |
| Example 2 | 950 | PVA | 2.5 | Reductive atmosphere | 1050 | Nitrogen (oxygen concentration: 0%) |
| Example 3 | 950 | PVA | 2.5 | Reductive atmosphere | 1000 | Nitrogen (oxygen concentration: 0%) |
| Example 4 | 750 | PVA | 3.5 | Reductive atmosphere | 1150 | Nitrogen (oxygen concentration: 0%) |
| Example 5 | 750 | PVA | 3.5 | Reductive atmosphere | 1100 | Nitrogen (oxygen concentration: 0%) |
| Example 6 | 950 | PVA | 2.0 | Reductive atmosphere | 1100 | Nitrogen (oxygen concentration: 0%) |
| Example 7 | 950 | PVA | 2.0 | Reductive atmosphere | 1050 | Nitrogen (oxygen concentration: 0%) |
| Example 8 | 950 | PVA | 2.5 | Reductive atmosphere | 1050 | Nitrogen (oxygen concentration: 0%) |
| Example 9 | 950 | PVA | 2.5 | Reductive atmosphere | 1050 | Nitrogen (oxygen concentration: 0%) |
| Example 10 | 950 | PVA | 2.5 | Reductive atmosphere | 1050 | Nitrogen (oxygen concentration: 0%) |
| Example 11 | 950 | PVA | 2.5 | Reductive atmosphere | 1050 | Nitrogen (oxygen concentration: 0%) |
| Comparative Example 1 | 950 | PVA | 1.5 | Reductive atmosphere | 1210 | Nitrogen (oxygen concentration: 0%) |
| Comparative Example 2 | 950 | PVA | 1.5 | Reductive atmosphere | 1150 | Nitrogen (oxygen concentration: 0%) |
| Comparative Example 3 | 1050 | — | — | Air | 1210 | Nitrogen (oxygen concentration: 0%) |
| Comparative Example 4 | 1050 | — | — | Air | 1180 | Nitrogen (oxygen concentration: 0%) |
| Comparative Example 5 | 1050 | — | — | Air | 1150 | Nitrogen (oxygen concentration: 0%) |
| Referential Example | 900 | — | — | Hydrogen gas | 1100 | Nitrogen (oxygen concentration: 0%) |

(*1) The amounts of MgO, $Fe_2O_3$ and SrO are the values converted from the composition at the time of the raw material mixing.

(*2) The gas introduced into the sintering apparatus is described.

(*3) MnO was used in place of MgO.

TABLE 2

| Example/ Comparative Example | Before final sintering: Saturation magnetization (with application of 3 kOe) $Am^2/kg$ | Before final sintering: Pore volume $mm^3/g$ | After final sintering: Properties of porous ferrite particle (ferrite carrier core material): Magnetization (with application of 1 kOe) $Am^2/kg$ | Saturation magnetization (with application of 3 kOe) $Am^2/kg$ | Remanent magnetization $Am^2/kg$ | Coercive force A/m | Pore volume $mm^3/g$ |
|---|---|---|---|---|---|---|---|
| Example 1 | 71 | 164.1 | 65 | 70 | 4 | 18 | 40.6 |
| Example 2 | 71 | 164.1 | 64 | 72 | 5 | 30 | 77.1 |
| Example 3 | 71 | 164.1 | 62 | 70 | 5 | 30 | 113.9 |
| Example 4 | 64 | 299.1 | 65 | 72 | 2 | 15 | 75.2 |
| Example 5 | 64 | 299.1 | 63 | 71 | 4 | 24 | 106.7 |
| Example 6 | 69 | 260.7 | 54 | 60 | 4 | 24 | 52.8 |
| Example 7 | 69 | 260.7 | 49 | 55 | 6 | 36 | 80.5 |
| Example 8 | 71 | 185.3 | 65 | 70 | 4 | 24 | 63.9 |
| Example 9 | 67 | 155.8 | 49 | 55 | 6 | 36 | 82.2 |
| Example 10 | 71 | 162.1 | 63 | 70 | 4 | 18 | 59.1 |
| Example 11 | 70 | 201.5 | 65 | 71 | 6 | 48 | 89.5 |
| Comparative Example 1 | 60 | 278.7 | 52 | 54 | 1 | 12 | 16.3 |
| Comparative Example 2 | 60 | 278.7 | 49 | 52 | 3 | 18 | 45.9 |
| Comparative Example 3 | 11 | 151.6 | 50 | 54 | 1 | 12 | 20.5 |
| Comparative Example 4 | 11 | 151.6 | 45 | 48 | 2 | 18 | 35.5 |
| Comparative Example 5 | 11 | 151.6 | 35 | 38 | 2 | 18 | 50.2 |
| Referential Example | 91 | 244.7 | 83 | 92 | 1 | 12 | 23.8 |

| Example/ Comparative Example | After final sintering: Properties of porous ferrite particle (ferrite carrier core material): Peak pore size μm | dv Value | Electric resistance Gap = 6.5 mm: 50 V Ω | 100 V Ω | Volume average particle size μm | Apparent density $g/cm^3$ |
|---|---|---|---|---|---|---|
| Example 1 | 0.40 | 0.24 | $1.7 \times 10^7$ | $4.5 \times 10^6$ | 35.0 | 1.68 |
| Example 2 | 0.50 | 0.19 | $1.5 \times 10^7$ | $3.6 \times 10^6$ | 35.7 | 1.53 |
| Example 3 | 0.49 | 0.17 | $4.5 \times 10^6$ | $2.1 \times 10^6$ | 36.0 | 1.29 |
| Example 4 | 0.61 | 0.22 | $2.8 \times 10^7$ | $2.1 \times 10^7$ | 37.1 | 1.52 |
| Example 5 | 0.68 | 0.21 | $1.2 \times 10^7$ | $3.2 \times 10^6$ | 37.2 | 1.25 |
| Example 6 | 0.52 | 0.26 | $2.9 \times 10^7$ | $1.4 \times 10^7$ | 37.3 | 1.59 |
| Example 7 | 0.53 | 0.28 | $2.0 \times 10^7$ | $7.8 \times 10^6$ | 35.8 | 1.38 |
| Example 8 | 0.55 | 0.24 | $1.1 \times 10^7$ | $2.5 \times 10^6$ | 35.8 | 1.55 |
| Example 9 | 0.48 | 0.36 | $3.6 \times 10^7$ | $1.9 \times 10^6$ | 36.0 | 1.42 |
| Example 10 | 0.50 | 0.27 | $1.8 \times 10^7$ | $2.2 \times 10^6$ | 36.0 | 1.65 |
| Example 11 | 0.71 | 0.41 | $3.0 \times 10^7$ | $8.3 \times 10^6$ | 37.8 | 1.50 |
| Comparative Example 1 | 0.29 | 0.49 | $7.5 \times 10^7$ | $1.5 \times 10^7$ | 36.4 | 1.91 |
| Comparative Example 2 | 0.52 | 0.26 | $2.4 \times 10^7$ | $7.5 \times 10^6$ | 35.7 | 1.62 |
| Comparative Example 3 | 0.85 | 0.74 | $5.4 \times 10^8$ | $3.2 \times 10^8$ | 39.3 | 1.88 |
| Comparative Example 4 | 0.89 | 0.68 | $4.4 \times 10^8$ | $3.2 \times 10^8$ | 40.0 | 1.75 |
| Comparative Example 5 | 0.94 | 0.81 | $3.8 \times 10^8$ | $3.5 \times 10^8$ | 40.4 | 1.64 |
| Referential Example | 0.27 | 0.36 | $9.0 \times 10^6$ | Equal to or less than lower measurement limit | 36.5 | 2.24 |

TABLE 3

| | Saturation magnetization ratio (before final sintering/after final sintering) | Pore volume ratio (before final sintering/after final sintering) |
|---|---|---|
| Example 1 | 1.01 | 4.0 |
| Example 2 | 0.99 | 2.1 |
| Example 3 | 1.01 | 1.4 |
| Example 4 | 0.89 | 4.0 |
| Example 5 | 0.90 | 2.8 |
| Example 6 | 1.15 | 4.9 |
| Example 7 | 1.25 | 3.2 |
| Example 8 | 1.01 | 2.9 |
| Example 9 | 1.22 | 1.9 |
| Example 10 | 1.01 | 2.7 |
| Example 11 | 0.99 | 2.3 |
| Comparative Example 1 | 1.11 | 17.1 |
| Comparative Example 2 | 1.15 | 6.1 |
| Comparative Example 3 | 0.20 | 7.4 |
| Comparative Example 4 | 0.23 | 4.3 |
| Comparative Example 5 | 0.29 | 3.0 |
| Referential Example | 0.99 | 10.3 |

the present invention, within a certain temperature range, the pore volume is varied depending on the temperature, but the magnetization is stabilized within a certain range. On the other hand, as can be seen from FIGS. 1 and 2, in the ferrite particles of Comparative Examples 3 to 5, the decrease of the final sintering temperature tends to increase the pore volume, and at the same time, degrades the magnetization. In the ferrite particles of Comparative Examples 1 and 2, the magnetization appears to be stabilized within a certain final sintering temperature region, but the absolute values of the saturation magnetization are lower as compared to the ferrite particles of the present invention.

Additionally, the ferrite particle using Mn in place of Mg, quoted as a referential example, succeeded in increasing the magnetization, but had a very low resistance and the resistance thereof was equal to or less than the lower measurement limit already at the time of the application of 100 V. In recent development systems aiming at high image quality enhancement and at speeding-up, the development gap is small and the development bias is high, and hence the electric field strength exerted on the developer is very high. Therefore,

TABLE 4

| | | | | Carrier properties after resin filling and surface coating | | | | |
|---|---|---|---|---|---|---|---|---|
| Examples/ Comparative Example | Porous ferrite particle | Resin filling Resin amount (*4) Parts by weight | Resin coating Resin amount (*5) Parts by weight | Saturation magnetization (with application of 3 kOe) $Am^2/kg$ | Volume average particle size μm | Particles of less than 24 μm vol % | Apparent density $g/cm^3$ | Particle density $g/cm^3$ |
| Example 12 | Example 2 | 9 | 1 | 65 | 36.6 | 0.7 | 1.44 | 3.93 |
| Example 13 | Example 3 | 13 | 1 | 59 | 37.3 | 2.5 | 1.16 | 3.58 |
| Comparative Example 6 | Comparative Example 3 | 4 | 1 | 51 | 39.7 | 4.8 | 1.84 | 4.42 |

| | | Carrier properties after resin filling and surface coating | | | Evaluations | | | |
|---|---|---|---|---|---|---|---|---|
| Examples/ Comparative Example | Porous ferrite particle | Charge amount, initial μC/g | Charge amount, after stirring μC/g | Charge amount variation: Initial - after stirring μC/g | Weight reduction (particle density) | Magnetic property (saturation magnetization) | Charging property A (absolute value) | Charging property B (charge amount variation) |
| Example 12 | Example 2 | 57.7 | 55.2 | 2.5 | A | A | A | A |
| Example 13 | Example 3 | 56.2 | 55.2 | 1.0 | B | B | A | A |
| Comparative Example 6 | Comparative Example 3 | 53.4 | 45.9 | 7.5 | C | D | B | D |

(*4) The resin filing amount represents the filling resin solid content (parts by weight) in relation to 100 parts by weight of the porous ferrite particle.
(*5) The resin coating amount represents the coating resin solid content (parts by weight) in relation to 100 parts by weight of the particle after resin filling.

As is clear from Tables 1 to 3, the porous ferrite particles of Examples 1 to 11 according to the present invention each have a saturation magnetization, a magnetic property, at a high level of 55 $Am^2/kg$ or more and each have an intended pore volume. On the other hand the ferrite particles of Comparative Examples 1 to 5 each have a low saturation magnetization and a relatively small pore volume so as to make it difficult to reduce the specific gravity by resin filling.

In particular, only the final sintering temperature was varied within each of the following four groups, namely, Examples 1 to 2, Examples 4 and 5, Comparative Examples 1 and 2, and Comparative Examples 3 to 5; as is clear from FIGS. 1 and 2 respectively showing the relation between the final sintering temperature and the saturation magnetization and the relation between the final sintering temperature and the pore volume, in the porous ferrite particles according to probably the use of such a ferrite particle as quoted as a referential example, as the ferrite carrier core material, easily causes dielectric breakdown and causes critical image defects.

Additionally, in the ferrite particle obtained in this referential example, the pore volume is smaller as compared to the pore volumes in Examples, and the pore size is extremely small, and hence it is difficult to fill a resin in the concerned ferrite particle and it is impossible to obtain an intended resin-filled ferrite carrier.

As is clear from Table 4, the resin-filled ferrite carriers of Examples 12 and 13 using the porous ferrite particles according to the present invention each have an intended low particle density and hence are each excellent in durability, and additionally, each have a high charging ability (the initial charge amount), each maintain the high charge amount even after stirring, and each maintains the magnetization in an intended range.

On the other hand, the ferrite carrier of Comparative Example 6 using the porous ferrite particle of Comparative Example 3 has a low magnetization, and leads to an apprehension that the carrier beads carry over occurs. Additionally, it is interpreted that probably because the concerned ferrite carrier has a high particle density and undergoes high stirring stress, the variation of the charge amount is large and the concerned ferrite carrier is poor in durability.

The resin-filled ferrite carrier core material for an electrophotographic developer and the ferrite carrier according to the present invention are of a resin-filled type, and hence are low in specific gravity and are allowed to achieve weight reduction, accordingly are excellent in durability and are allowed to attain long operating lives, and moreover, are higher in strength as compared to the magnetic powder-dispersed carrier and are free from the occurrence of the cracking, deformation and melting due to heat or impact. Additionally, the concerned resin-filled ferrite carrier core material and the concerned ferrite carrier are capable of maintain high charging ability over a long period of time, are capable of attaining high image quality and are capable of reducing image defects. Yet additionally, the concerned resin-filled ferrite carrier core material and the concerned ferrite carrier are free from the use of heavy metals, and hence are adaptable to the current environmental regulation.

Consequently, the resin-filled carrier for an electrophotographic developer according to the present invention can be widely used in the fields associated with machines such as full-color machines required to be high in image quality and high-speed machines required to be satisfactory in the reliability and durability in the image maintenance.

What is claimed is:

1. A resin-filled ferrite carrier core material for an electrophotographic developer, comprising a porous ferrite particle, wherein the composition of the porous ferrite particle is represented by the following formula (1), and part of (MgO) and/or ($Fe_2O_3$) in the following formula (1) is replaced with SrO:

$$(MgO)x(Fe_2O_3)y \quad (1)$$

$$\begin{pmatrix} x = 10 \text{ mol \% or more and less than 25 mol \%} \\ y = \text{exceeding 75 mol \% and 90 mol \% or less} \\ x + y = 100 \text{ mol \%} \end{pmatrix}$$

wherein the pore volume of the porous ferrite particle is 40 to 160 $mm^3/g$, the peak pore size of the porous ferrite particle is 0.3 to 2.0 μm, and the pore size variation dv, in the pore size distribution, represented by the following formula (2) is 1.5 or less:

$$dv = |d_{84} - d_{16}|/2 \quad (2)$$

$d_{16}$: Pore size calculated from the pressure applied to mercury when the amount of the intruded mercury reaches 16% in relation to the total amount of the intruded mercury in the high pressure region, defined as 100%

$d_{84}$: Pore size calculated from the pressure applied to mercury when the amount of the intruded mercury reaches 84% in relation to the total amount of the intruded mercury in the high pressure region, defined as 100%.

2. The resin-filled ferrite carrier core material for an electrophotographic developer according to claim 1, wherein the replacement amount of SrO is 0.1 to 2.5 mol % of the porous ferrite particle.

3. The resin-filled ferrite carrier core material for an electrophotographic developer according to claim 1, wherein the saturation magnetization of the porous ferrite particle is 55 to 80 $Am^2/kg$.

4. The resin-filled ferrite carrier core material for an electrophotographic developer according to claim 1, wherein the saturation magnetization of the porous ferrite particle before the step of final sintering is 55 to 80 $Am^2/kg$, and the ratio between the saturation magnetization before the step of final sintering and the saturation magnetization after the step of final sintering (the saturation magnetization before the step of final sintering/the saturation magnetization after the step of final sintering) is 0.75 to 1.25.

5. The resin-filled ferrite carrier core material for an electrophotographic developer according to claim 1, wherein the pore volume of the porous ferrite particle before the step of final sintering is 150 $mm^3/g$ or more, and the ratio between the pore volume before the step of final sintering and the pore volume after the step of final sintering (the pore volume before the step of final sintering/the pore volume after the step of final sintering) is 1.2 to 6.0.

6. A resin-filled ferrite carrier for an electrophotographic developer, obtained by filling a resin in the pores of the ferrite carrier core material comprising the ferrite particle according to claim 1.

7. The resin-filled ferrite carrier for an electrophotographic developer according to claim 6, wherein the resin is a silicone resin.

8. The resin-filled ferrite carrier for an electrophotographic developer according to claim 6, wherein the amount of the resin filled in the porous ferrite particle is 6 to 20 parts by weight in relation to 100 parts by weight of the porous ferrite particle.

9. The resin-filled ferrite carrier for an electrophotographic developer according to claim 6, wherein the surface of the resin-filled ferrite carrier for an electrophotographic developer is coated with a resin.

10. The resin-filled ferrite carrier for an electrophotographic developer according to claim 6, wherein the volume average particle size thereof is 20 to 70 μm, the saturation magnetization thereof is 53 to 78 $Am^2/kg$, the particle density thereof is 3.5 to 4.3 $g/cm^3$, the apparent density thereof is 1.0 to 2.2 $g/cm^3$ and the content of the particles of less than 24 μm is 5% by volume or less.

11. An electrophotographic developer comprising the resin-filled ferrite carrier according to claim 6 and a toner.

12. The electrophotographic developer according to claim 11, used as a refill developer.

* * * * *